US006616258B2

(12) United States Patent
Maeda

(10) Patent No.: US 6,616,258 B2
(45) Date of Patent: Sep. 9, 2003

(54) INK-JET RECORDING APPARATUS AND DRIVING METHOD FOR INK-JET RECORDING HEAD

(75) Inventor: Kazuyuki Maeda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/052,432

(22) Filed: Jan. 23, 2002

(65) Prior Publication Data

US 2002/0101465 A1 Aug. 1, 2002

(30) Foreign Application Priority Data

Jan. 31, 2001 (JP) ..... 2001-024546

(51) Int. Cl.[7] ..... B41J 29/38
(52) U.S. Cl. ..... 347/12; 347/10
(58) Field of Search ..... 347/12, 15

(56) References Cited

U.S. PATENT DOCUMENTS 5,280,310 A 1/1994 Otsuka et al. ..... 347/12
5,481,281 A * 1/1996 Otsuka et al. ..... 347/12
6,161,912 A * 12/2000 Kitahara et al. ..... 347/9
6,439,687 B1 * 8/2002 Inoue ..... 347/41

FOREIGN PATENT DOCUMENTS

JP 5-84911 4/1993 ..... B41J/2/05

* cited by examiner

*Primary Examiner*—Hai Pham
*Assistant Examiner*—Alfred Dudding
(74) *Attorney, Agent, or Firm*—Fitzpatrick, Cella, Harper & Scinto

(57) ABSTRACT

An ink-jet head having a plurality of discharge openings for discharging ink therefrom, and an ink chamber which communicates with the discharge openings is driven so as to achieve stable ink discharging operation, by preventing meniscus vibration caused by resonance of the meniscus surface of the ink at the discharging openings in response to the pressure wave which is produced in the ink chamber due to changes in pressure in the ink chamber resulting from the ink discharging operation. More specifically, the driving timing of the ink-jet head is adjusted in a time division manner within a predetermined driving period.

10 Claims, 25 Drawing Sheets

INK-JET RECORDING APPARATUS AND DRIVING METHOD FOR INK-JET RECORDING HEAD

BACKGROUND OF THE INVENTION

1. Field of the Invention

The present invention relates to a device and method for driving an ink-jet head which performs printing by ejecting ink onto a printing medium, and to an ink-jet printing apparatus using the driving device.

2. Description of the Related Art

Printing apparatuses suitably used as image-output means in printers, copying machines, facsimiles, and the like record an image formed of a dot pattern on a printing medium such as paper, a plastic thin plate, cloth, or the like in accordance with given image information. The printing apparatuses are classified into an ink-jet type, a wire-dot type, a thermal type such as a thermal transfer type, a laser beam type, and the like according to their image-forming methods. Among these types, an ink-jet printing apparatus ejects ink (recording liquid), for example, in a droplet form from a discharge opening of an ink-jet head onto a printing medium, thereby printing an image on the printing medium.

An ink-jet head suitably used in such an ink-jet printing apparatus is known in which an electrothermal conversion element (discharge heater) is disposed in a channel which communicates with each discharge opening, and ink is discharged by using the expansion power of a bubble generated by heat which is produced by energizing the discharge heater (for example, a bubble-jet type, advocated by the present applicant, which discharges ink by producing film boiling in ink). This type of ink-jet head can be produced through a process similar to a semiconductor manufacturing process. For this reason, the size of the discharge heater disposed adjacent to the discharge opening or along the channel disposed on the inner side (the discharge opening and the channel will be generically named a "nozzle", unless otherwise specified) can be made much smaller than that of an energy producing element which has been hitherto used to discharge ink. This enables high-density mounting of nozzles.

In an ink-jet head having multiple nozzles mounted therein, normally, discharge heaters are divided into a plurality of blocks in order to limit the number of discharge heaters to be simultaneously driven in consideration of the upper limit of the maximum power consumption, and the ink-jet head is driven block by block in a time division manner within a predetermined driving period.

A related art of such time-division driving will be described with reference to FIGS. 1 to 4.

FIG. 1A shows the correspondence between nozzles arranged in the ink-jet head, and the waveforms of signals to be applied to discharge heaters corresponding to the nozzles.

An ink-jet head 1000 shown in FIG. 1A is schematically shown, as viewed from the front side of a discharge opening. Ink is discharged from nozzles or discharge openings 1 to 12, and lands on a printing medium, thereby forming an image thereon. Recent ink-jet heads have a tendency to have 200 to 2000 nozzles mounted thereon for higher printing speed and higher image quality. Herein, the ink-jet head 1000 includes twelve nozzles for ease of explanation.

A timing chart on the right side of the ink-jet head 1000 shows the waveforms of signals to be applied to discharge heaters in the nozzles. The vertical axis represents the applied voltage. A state in which the voltage is high (H) means an energized (ON) state, and a state in which the voltage is low (L) means a non-energized (OFF) state. The horizontal axis represents the time.

For convenience, the nozzles 1 to 12 are arranged in numerical order from the top of the figure. The nozzles 1 to 12 are divided into four blocks of three. Each block includes discharge heaters to be simultaneously driven, and is driven individually. When the applied voltage is high, the discharge heater is energized, and ink is discharged by using the expansion power of a bubble generated by heat. In contrast, when the applied voltage is low, the discharge heater is not energized, and ink is not discharged. The nozzles 1 to 12 are driven in a time division manner, that is, the nozzles 1, 5, and 9 are driven at a first block time, the nozzles 2, 6, and 10 at a second block time, the nozzles 3, 7, and 11 at a third block time, and the nozzles 4, 8, and 12 at a fourth block time. As a result, the discharge openings of the first to fourth blocks sequentially perform discharge operation.

FIG. 2 is a circuit diagram of a driving circuit for such time-division driving in the related art, and FIG. 3 is an operation timing chart of the components in the driving circuit.

Referring to FIG. 2, a one-shot circuit 100 detects the rising edge of a predetermined encoder signal, and generates a one-shot pulse signal A. For example, in a so-called serial type printing apparatus, encoder signals are generated at regular intervals during a main scanning process of the ink-jet head with respect to a printing medium. The one-shot pulse signal A is supplied to a timer circuit 114 and to a one-shot circuit 102 in parallel.

The timer circuit 114 is reset by the pulse signal A, and generates signals B at regular intervals. The timer circuit 114 is connected to a shift circuit 103 and a heating pulse generating circuit 104 so that the signals B are input thereto. The signal B serves as a reference signal for a block driving period shown in FIG. 1A.

The configuration and operation of the timer circuit 114 will now be described with reference to FIGS. 4A and 4B. FIG. 4A is a circuit diagram of the timer circuit 114, and FIG. 4B is an operation timing chart thereof. Reference numerals 110, 111, 112, and 113 denote toggle flip-flops (hereinafter referred to as "TFFs"). A pulse to be input to the TFF 110 is a square wave having a frequency of, for example, 800 kHz. The TFF 110 inverts a pulse signal Q1 output from a terminal Q at every rising edge of the input pulse signal. In this way, the TFF can reduce the frequency to half by dividing the input signal. Since four TFFs are connected in series in FIG. 1A, an output pulse B from the last TFF 113 is a square wave of 50 kHz.

The above-described pulse signal A is supplied to a reset input terminal R of each of the TFFs 110 to 113. For this reason, the TFFs 110 to 113 are reset in response to every input of a one-shot pulse signal A, and output signals Q1, Q2, Q3, and Q4 therefrom become low. When a pulse signal having a frequency of 800 kHz is input to the TFF 110, the TFFs 110 to 113 are triggered at the falling edge of the signal A, and a signal B divided by the four TFFS 110 to 113 is output.

Referring to FIGS. 2 and 3, the one-shot circuit 102 generates a one-shot pulse signal at the falling edge of the signal B, and outputs an OR signal C between the pulse signal and the pulse signal A. The signal C is supplied to a heating-pulse generating circuit 104. On the other hand, a shift circuit 103 of a Johnson counter type outputs pulse signals QA1 to QA4 in a time division manner in response to the signal B, as shown in FIG. 3, and inputs the pulse signals to the heating-pulse generating circuit 104.

The heating-pulse generating circuit 104 generates signals for energizing the discharge heaters, and outputs the signals to a driver circuit 105. Information about the ON time of the discharge heaters for discharging ink is supplied from a microcomputer or the like (not shown) serving as a control section in the printing apparatus, and the ON time (heat pulse width) of the discharge heaters is determined on the basis of the information. As shown in FIG. 3, the heating-pulse generating circuit 104 outputs a block driving signal BL1 for a period, which is determined on the basis of the information at the rising edge of the pulse signal QA1, and supplies the signal to the driver circuit 105. Similarly, the heating-pulse generating circuit 104 outputs block driving signals BL2, BL3, and BL4 for the periods determined on the basis of the information at the rising edges of the pulse signals QA2, QA3, and QA4, respectively.

The driver circuit 105 supplies driving signals to the discharge heaters corresponding to the nozzles which are caused to discharge ink according to image information. Signals G1 to G12 (signals which determine, on the basis of the image information, whether or not discharging is performed by the nozzles) are supplied to the driver circuit 105 according to the image information, and are input from the control section (not shown). That is, the driver circuit 105 generates driving signals for the discharge heaters which are activated by the signals G1 to G12, in response to the block driving signals BL1 to BL4.

FIG. 1B shows the changes in pressure inside an ink chamber due to the driving of the discharge heaters or the discharging operation of the nozzles described above. The vertical axis represents the pressure and the horizontal axis represents the time. A broken line along the horizontal axis shows the pressure equal to the outside pressure. A part over the broken line shows that the pressure inside the ink chamber is high, and a part under the broken line shows that the pressure is low.

When it is assumed that the driving period of the entire ink-jet head is designated a discharge period, one discharge period includes a period between the beginning of a driving period assigned to the first block (a block period "1" in FIG. 1A) and the end of a driving period assigned to the fourth block (a block period "4" in FIG. 1A) (hereinafter referred to as "ON period"), and a period between the end of the driving period of the fourth block and the beginning of the next driving operation of the first block (hereinafter referred to as "OFF period"). During the ON period, a bubble generated by heat generation of the discharge heater acts to discharge ink from the discharge opening, and simultaneously acts to push the ink back into the ink chamber of the nozzle. Therefore, the pressure inside the ink chamber increases. In contrast, during the OFF period, the pressure inside the ink chamber is decreased by a refilling operation (operation of refilling the nozzle with ink by capillary action). When the ink-jet head 1000 is continuously driven, the ON period and the OFF period are alternately established, and the pressure inside the ink chamber varies during the discharge period. This causes a pressure wave in the ink chamber.

In the method for discharging ink by applying heat energy to the ink, as in the above-described bubble-jet method, when the ink is rapidly heated by the discharge heater, water, which serves as the principal component of the ink, adjacent to the surface of the discharge heater changes state, and turns into vapor. This vapor produces a bubble, and the ink is discharged by using the expansion power of the bubble as motive power. When the discharge heater is deenergized, the bubble disappears as the vapor returns to water. However, when the temperature of the ink increases due to the continuous driving, the air in the ink cannot be dissolved in the ink, and stays as a bubble.

In general, ink discharging operation must be repeated many times in order to form an image with a lot of ink dots. One nozzle sometimes discharges ink several thousands to several ten thousands of times. Consequently, bubbles produced by the dissolved air, as described above, sometimes accumulate, grow in size to a relatively large diameter with time, and stay inside the ink chamber. In such a case, the natural frequency of a meniscus surface at the discharge opening of the nozzle (an interface between the ink and air (outside air)) decreases, and the meniscus surface tends to vibrate. When the natural frequency approaches the driving frequency, resonance is likely to occur. In a resonant state, the ink at the discharge opening is convex toward the outside of the nozzle when the pressure in the ink chamber increases, and is concave toward the inside of the nozzle when the pressure decreases. The states of the ink repeatedly changes, and the meniscus surface vibrates (hereinafter, this phenomenon will be referred to as "meniscus vibration").

When a discharging operation is performed in such a state in which the ink at the discharge opening is convex, the amount of ink to be discharged ink is increased. Conversely, when a discharging operation is performed in a state in which the ink is concave, the amount of ink to be discharged is decreased. When the amount of ink to be discharged from the nozzle varies in such a manner, the image quality deteriorates, for example, bands appear in a formed image.

This phenomenon will be described with reference to FIG. 1C. FIG. 1C shows the sectional side of the ink-jet head, and the states of meniscus vibrations caused at the discharge openings of the nozzles. The vertical axis represents the state of a surface between the ink at the discharge opening of each nozzle, and air (meniscus surface). A state in which the meniscus surface is placed on a broken line corresponding to the discharge opening shows a normal state. As the meniscus surface becomes higher than in this state, it becomes more convex toward the outside of the discharge opening. Conversely, as the meniscus surface becomes lower than in this state, it becomes more concave toward the inside of the discharge opening.

In FIG. 1C, a bubble 1004 remains in an ink chamber 1001, as described above, and exists adjacent to the nozzle 1. At the nozzle closer to such a remaining bubble 1004, the meniscus surface is more prone to resonate, and the amplitude of the meniscus vibration is higher. In contrast, at the nozzle further apart from the bubble 1004, the meniscus surface is less prone to resonate, and the amplitude of the meniscus vibration is low. Such differences in meniscus vibration cause variations in the amount of ink discharged from the nozzles, and the discharging direction. As a result, bands are formed in a printed image due to nonuniform printing, and the image quality deteriorates.

Accordingly, the present applicant has proposed an ink-jet recording apparatus in which ink is discharged from a number of (one) discharge openings of a plurality of discharge openings in an ink-jet head, which discharges an amount of ink corresponding to 7% or less of the amount of ink discharged from all (sixty-four) the discharge openings, at the same time, and in which the total ink discharge period of all the discharge openings is set to be 70% or more of the driving period (Japanese Laid-Open Patent No. 05-084911).

The above publication teaches that the amount of ink to be discharged within a unit time can be minimized, the level of the negative pressure produced in the ink chamber can be brought closest to the normal pressure, and this makes it possible to minimize the amplitude of the vibration caused in the refilling operation, to stabilize discharging, and to further increase the driving frequency.

The technique disclosed in the above publication will be described with reference to FIGS. 1A to 1C. In the publication, "the total ink discharge period is set to be 70% or more of the driving period" means that the ON period is 70% or more of the discharge period. This can be expressed by the following equation:

ON period>discharge period×0.7

By making such a condition, the variations in pressure in the ink chamber shown in FIG. 1B are reduced. Even when the remaining bubble 1004 shown in FIG. 1C grows, the amplitude of the meniscus vibration is decreased. That is, as the ON period further approximates the driving period, the driving frequency components in the pressure wave in the ink chamber reduced. As a result, the meniscus vibration is lessened.

However, since an operation of transferring data for discharging to the ink-jet head is performed during the OFF period, the OFF period cannot be removed. As the OFF period exists, the driving frequency component remains in the pressure wave in the above driving method. Consequently, resonance of the meniscus surface and the meniscus vibration are unavoidable. As long as the meniscus vibration occurs, the amount of ink to be discharged and the discharging direction vary depending on the ink discharging timing, as described above, and the quality of printed images is lowered.

SUMMARY OF THE INVENTION

The present invention has been made to overcome the above problems, and relates to a technique for reducing meniscus vibration in order to stabilize an ink discharging operation and to achieve high-quality printing.

According to an aspect of the present invention, there is provided an ink-jet recording apparatus for performing recording by using an ink-jet head having a plurality of discharge openings for discharging ink therefrom, and an ink chamber for supplying the ink to the discharge openings. The ink-jet recording apparatus includes a block dividing means for dividing a plurality of recording elements for discharging the ink from the discharge openings into a plurality of blocks, and driving the recording elements block by block, and a control means for driving the recording elements so that driving periods of the blocks are not equal.

According to another aspect of the present invention, there is provided an ink-jet recording apparatus for performing recording by using an ink-jet head having a plurality of discharge openings for discharging ink therefrom, and an ink chamber for supplying the ink to the discharge openings. The ink-jet recording apparatus includes a block dividing means for dividing a plurality of recording elements for discharging the ink from the discharge openings into a plurality of blocks, and driving the recording elements within predetermined driving periods, and a control means for driving the recording elements so that the time at which the driving of the first block starts varies according to the driving periods.

According to a further aspect of the present invention, there is provided a driving method for an ink-jet head having a plurality of discharge openings for discharging ink therefrom, and an ink chamber for supplying the ink to the discharge openings. The driving method includes a block dividing step of dividing a plurality of recording elements for discharging the ink from the discharge openings into a plurality of blocks, and driving the recording elements block by block, and a control step of driving the recording elements so that driving periods of the blocks are not equal.

According to a further aspect of the present invention, there is provided a driving method for an ink-jet head having a plurality of discharge openings for discharging ink therefrom, and an ink chamber for supplying the ink to the discharge openings. The driving method includes a block dividing step of dividing a plurality of recording elements for discharging the ink from the discharge openings into a plurality of blocks, and driving the recording elements within predetermined driving periods, and a control step of driving the recording elements so that the time at which the driving of the first block starts varies according to the driving periods.

According to the above structures, resonance of a meniscus surface which occurs in response to a pressure wave in the ink chamber is suppressed.

Since the meniscus vibration can be reduced by thus preventing the meniscus surface from resonating, it is possible to achieve a stable ink discharging state and to produce high-quality prints without any mottles and bands.

In this specification, "printing" (sometimes referred to as "recording") broadly encompasses not only forming meaningful characters, graphics, and the like based on information, but also forming images, patterns, and the like on printing media or performing processing on printing media, whether or not the images and the like are meaningful and whether or not they are visible to the human eyes.

A "printer" encompasses not only a completed apparatus for printing, but also a device which has a printing function.

A "printing medium" broadly encompasses not only paper to be used in a general type of printing apparatus, but also other materials which can receive ink, such as cloth, a plastic film, a metal plate, glass, ceramics, wood, and leather. Hereinafter, the printing medium will also be referred to as a "sheet" or simply as "paper".

Furthermore, "ink" (sometimes referred to as "liquid") is broadly defined herein in a manner similar to that of the above "printing", and means a liquid which is applied on a printing medium and is used to form images, patterns, and the like thereon, to process a printing medium, or to process ink (for example, to coagulate or insolubilize coloring materials in the ink applied on a printing medium).

Further objects, features and advantages of the present invention will become apparent from the following description of the preferred embodiments with reference to the attached drawings.

BRIEF DESCRIPTION OF THE DRAWINGS

FIG. 1A is an explanatory view showing the correspondence between discharge heaters disposed in the nozzles, and the waveforms of signals to be applied thereto, FIG. 1B is an explanatory view showing the changes in pressure in an ink chamber of an ink-jet head due to the driving of the discharge heaters or the discharging operation of the nozzles, and FIG. 1C is an explanatory view showing the states of meniscus vibrations caused at the discharge openings of the nozzles.

FIG. 13A is an explanatory view showing the correspondence between discharge heaters disposed in nozzles, and the waveforms of signals to be applied thereto, FIG. 13B is an explanatory view showing the changes in pressure in an ink chamber of an ink-jet head due to the driving of the discharge heaters or the discharging operation of the nozzles, and FIG. 13C is an explanatory view showing the states of meniscus vibrations caused at the discharge openings of the nozzles.

FIG. 23A is an explanatory view showing the correspondence between discharge heaters disposed in nozzles, and the waveforms of signals to be applied thereto, FIG. 23B is an explanatory view showing the changes in pressure in an ink chamber of an ink-jet head due to the driving of the discharge heaters or the discharging operation of the nozzles, and FIG. 23C is an explanatory view showing the states of meniscus vibrations caused at the discharge openings of the nozzles.

DESCRIPTION OF THE PREFERRED EMBODIMENTS

Figure 1A:
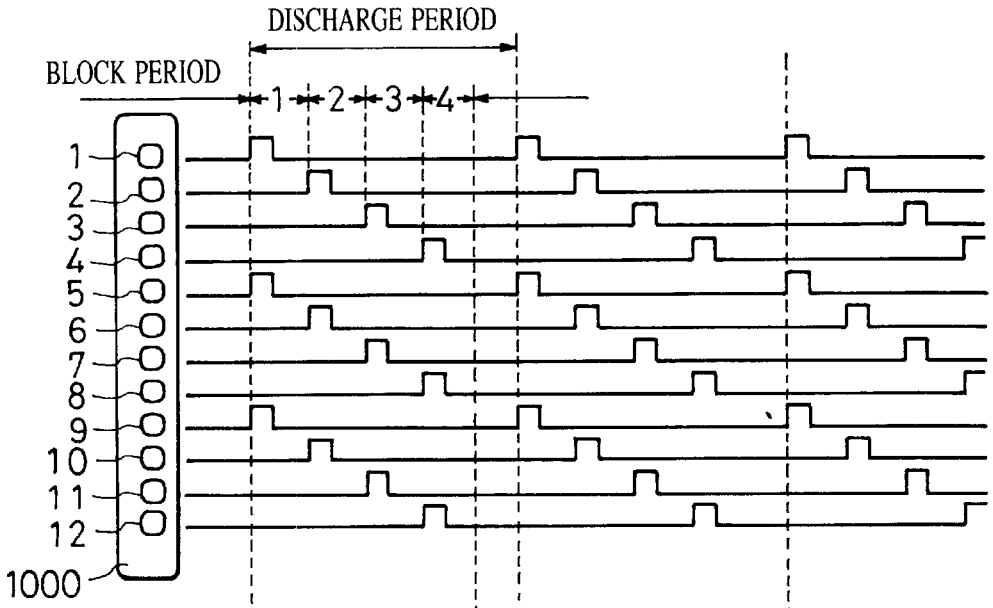
FIGS. 1A to 1C show problems caused in a time-division driving method for a plurality of nozzles as a related art.
Figure 1B:
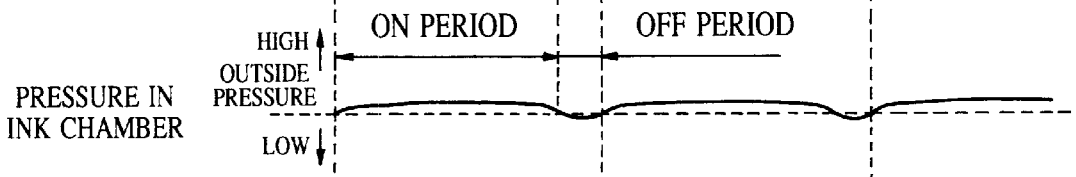
Figure 1C:
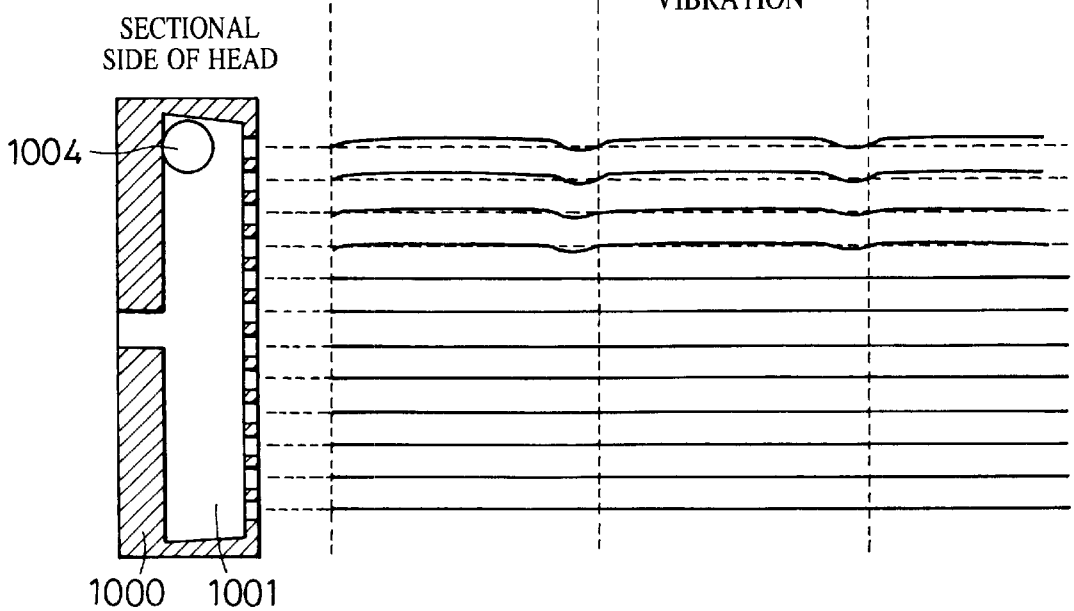

Embodiments of the present invention will be described below with reference to the attached drawings.

In the following description, the components which have structures or functions similar to those in the above-described related art are denoted by the same reference numerals.

Overall Configuration of Ink-Jet Printing Apparatus

Figure 5:
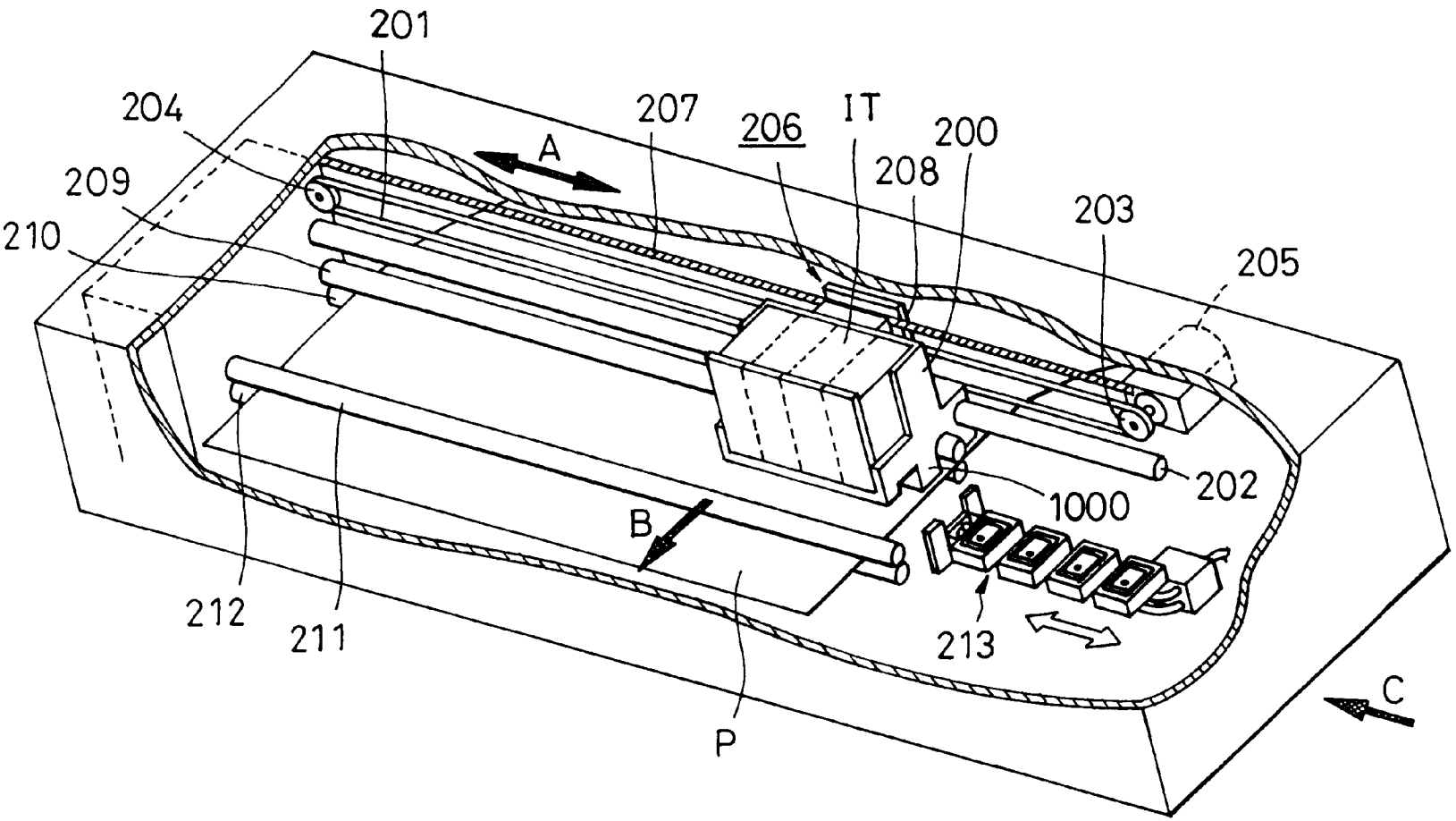
FIG. 5 is a schematic perspective view of an ink-jet printing apparatus to which the present invention is applicable.

FIG. 5 is a schematic perspective view of an ink-jet printing apparatus to which the present invention is applicable.

In the ink-jet printing apparatus, a carriage 200 is fixed to an endless belt 201 so that it can move along a guide shaft 202. The endless belt 201 is laid between pulleys 203 and 204, and a driving shaft of a carriage-driving motor 205 is connected to the pulley 203. Therefore, the carriage 200 is reciprocally moved along the guide shaft 202 in the main scanning direction (A-direction) by the rotation of the carriage-driving motor 205. An ink-jet head 1000 in which a plurality of nozzles are arranged, and an ink tank IT serving as a container for storing ink are mounted on the carriage 200.

The ink-jet printing apparatus also has a linear encoder 206 for detecting the position of the carriage 200. The linear encoder 206 includes a linear scale 207 which extends in the moving direction of the carriage 200 and has slits formed at equal intervals, for example, 600 slits per inch (about 25.4 mm), a slit detecting system 208 which is mounted on the carriage 200 and has, for example, a light-emitting portion and a photo-sensor, and a required signal processing circuit. Therefore, a discharge timing signal for determining the ink discharge timing, and information about the position of the carriage 200 are output from the linear encoder 206 in response to the movement of the carriage 200. In a case in which ink is discharged every time a slit is detected, printing can be performed with a resolution of 600 dpi (dot per inch) in the main scanning direction.

A recording sheet P serving as a printing medium is intermittently fed in the direction of the arrow B (sub-scanning direction) orthogonal to the main scanning direction of the carriage 200. The recording sheet P is supported by a pair of upstream roller units 209 and 210 and a pair of downstream roller units 211 and 212, and is transported while receiving a fixed tension so that the flatness thereof with respect to the ink-jet head 1000 is ensured. The force of driving the roller units 209 to 212 is applied from a recording-sheet transporting motor (not shown). In such a structure, the entire surface of the recording sheet P is printed by alternately performing the printing operation in the width corresponding to the width of the array of discharge openings of the ink-jet head 1000 with the movement of the carriage 200, and the feeding operation of the recording sheet P.

The carriage 200 is stopped at the home position at the beginning of a printing operation or during the printing operation as required. A cap member 213 for capping the discharge side of the ink-jet head 1000 is disposed at the home position. The cap member 213 is connected to a suction and recovery means (not shown) which prevents the discharge openings from being clogged by forcibly sucking the ink therefrom.

Structure of Ink-Jet Head

The structure of the ink-jet head 1000 which can be mounted in the above printing apparatus will now be described with reference to FIGS. 6 to 12.

Figure 6:
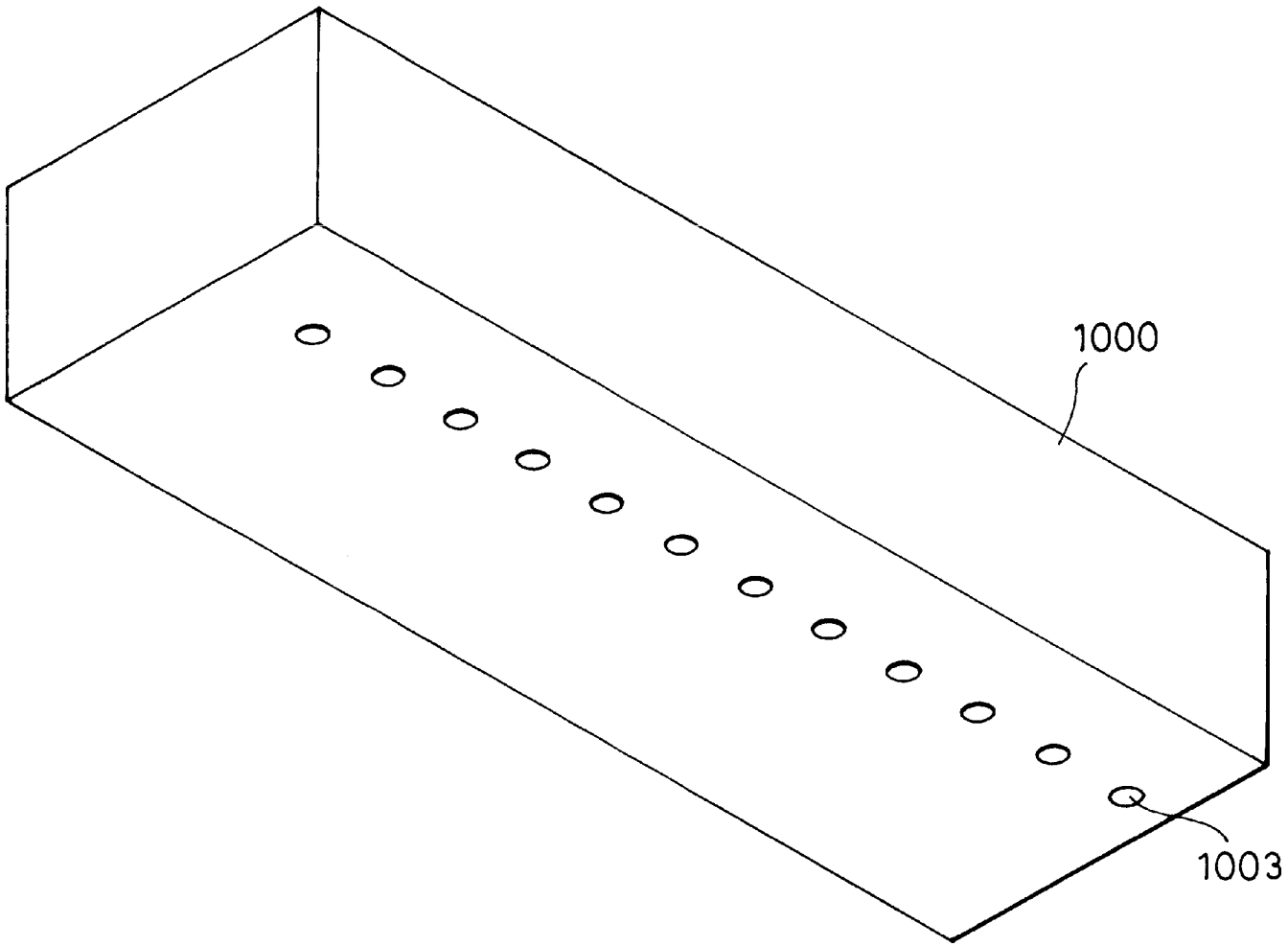
FIG. 6 is a perspective view showing the structure of an ink-jet head which can be mounted in the apparatus shown in FIG. 5.
Figure 7:
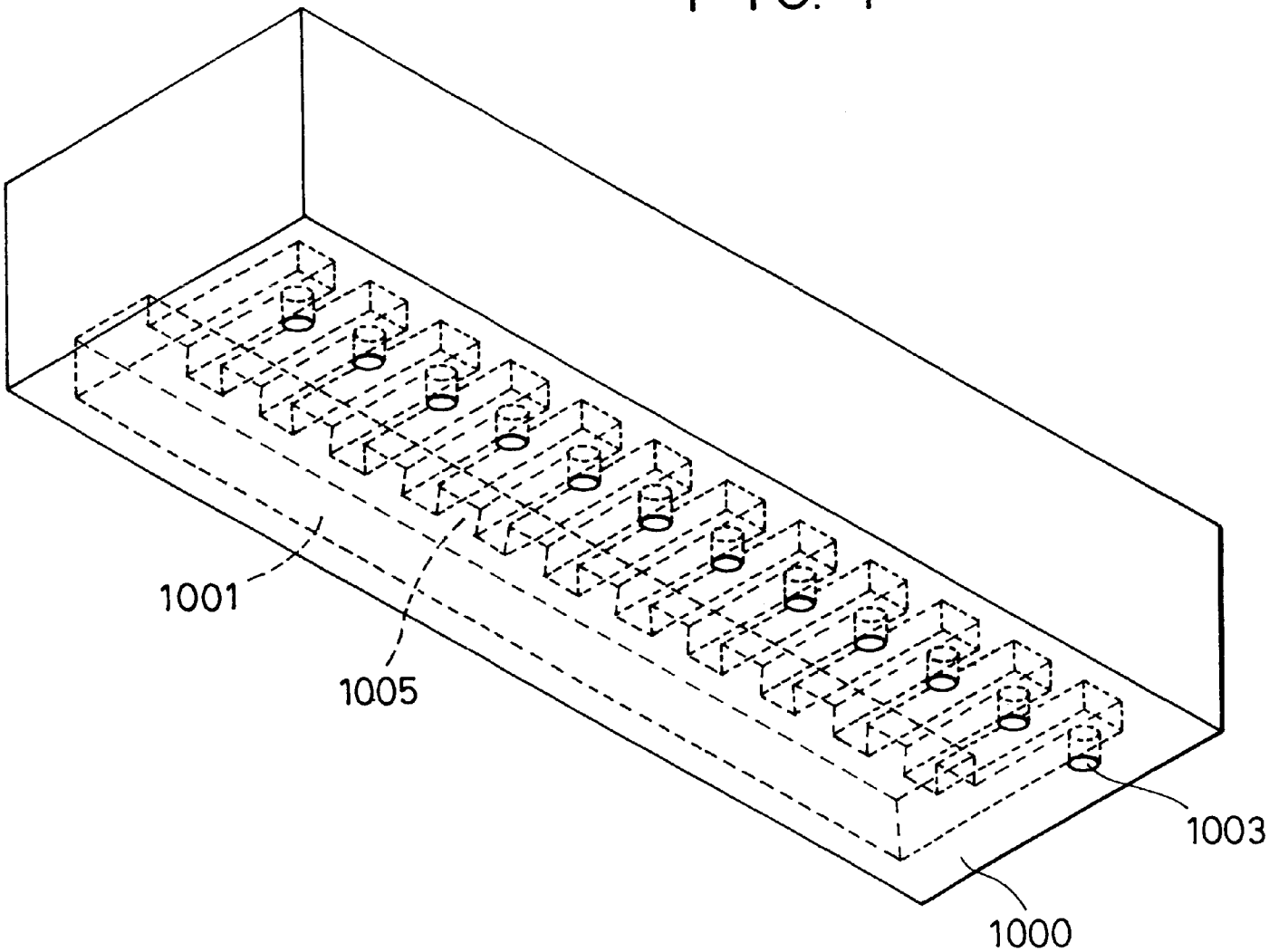
FIG. 7 is a perspective view showing the interior of the ink-jet head shown in FIG. 6.
Figure 8:
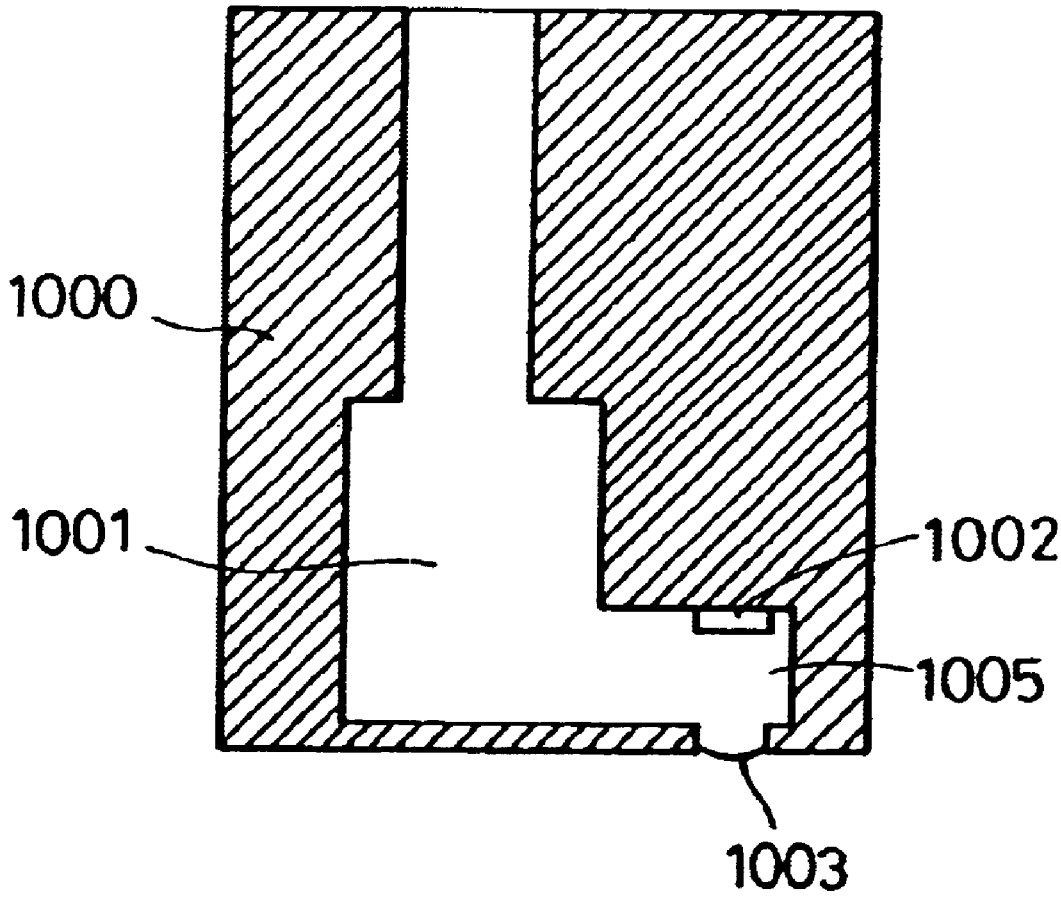
FIG. 8 is a sectional view of the ink-jet head shown in FIG. 6, taken in the direction perpendicular to the direction in which nozzles are arranged.
Figure 9:
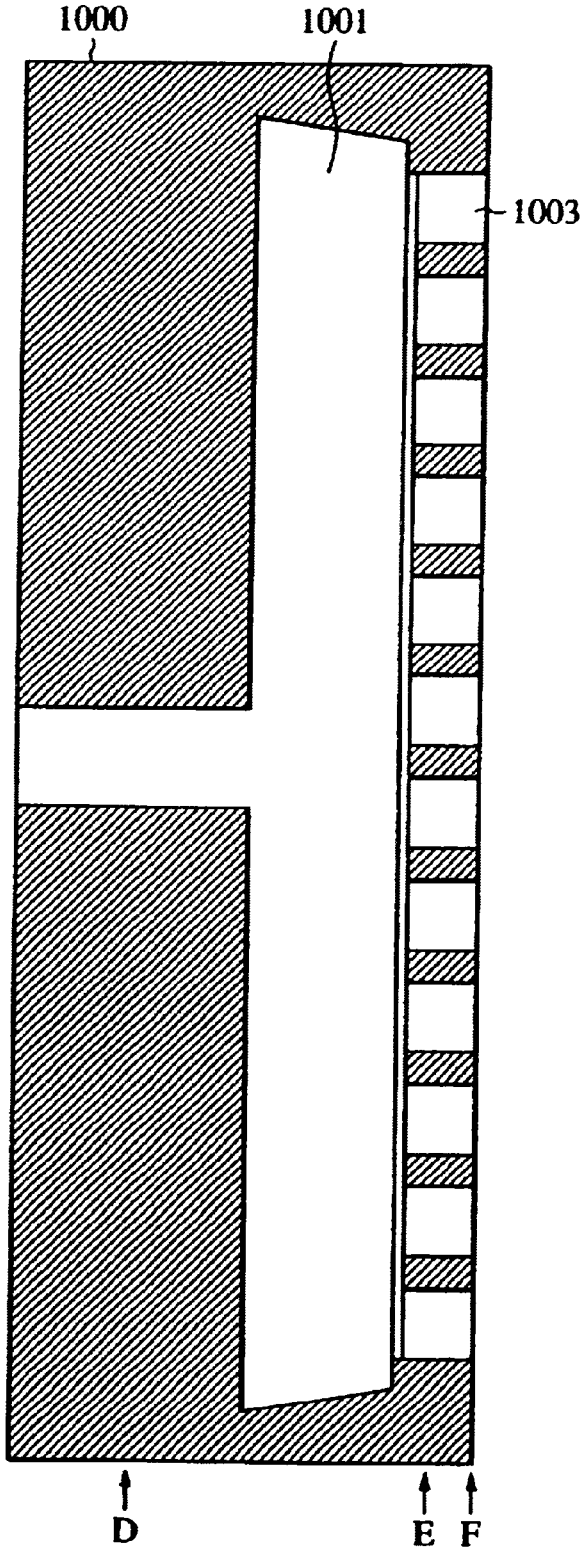
FIG. 9 is a sectional view of the ink-jet head shown in FIG. 6, taken in the direction in which the nozzles are arranged.
Figure 10:
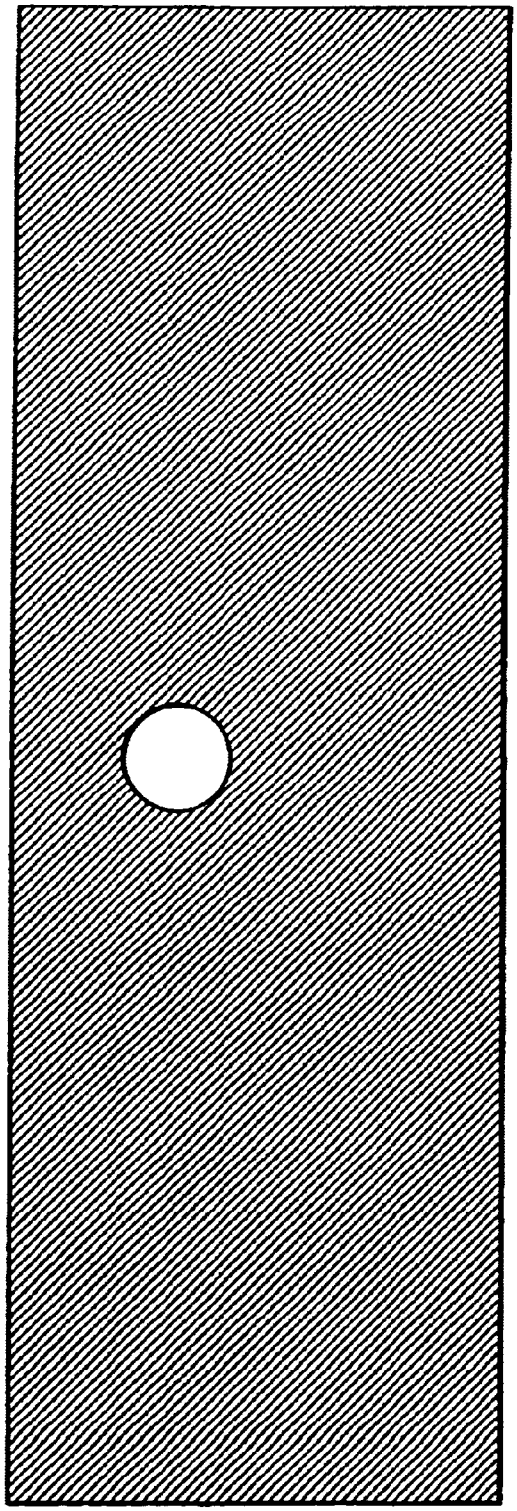
FIG. 10 is a sectional view of the ink-jet head shown in FIG. 6, taken along the plane D in parallel with a recording sheet P shown in FIG. 9.
Figure 11:
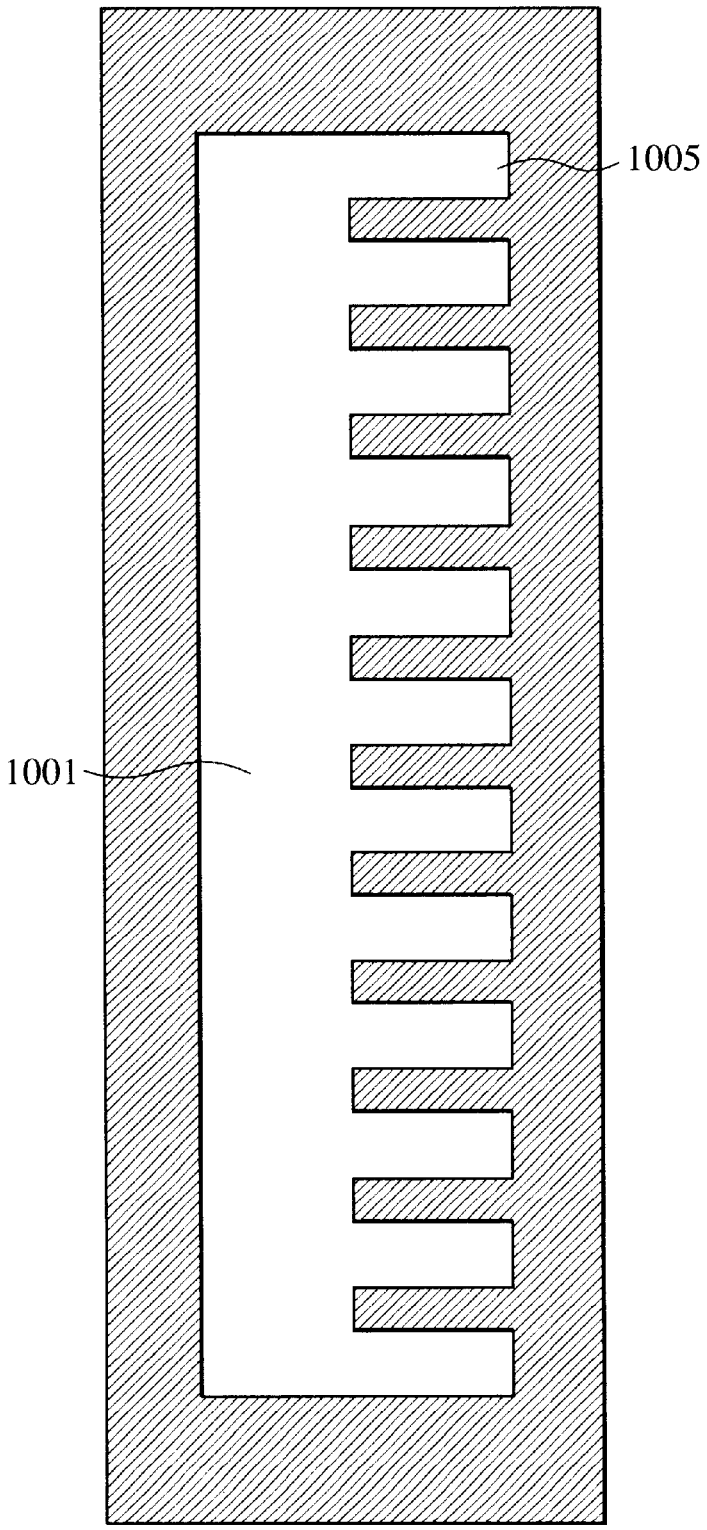
FIG. 11 is a sectional view of the ink-jet head shown in FIG. 6, taken along the plane E in FIG. 9.
Figure 12:
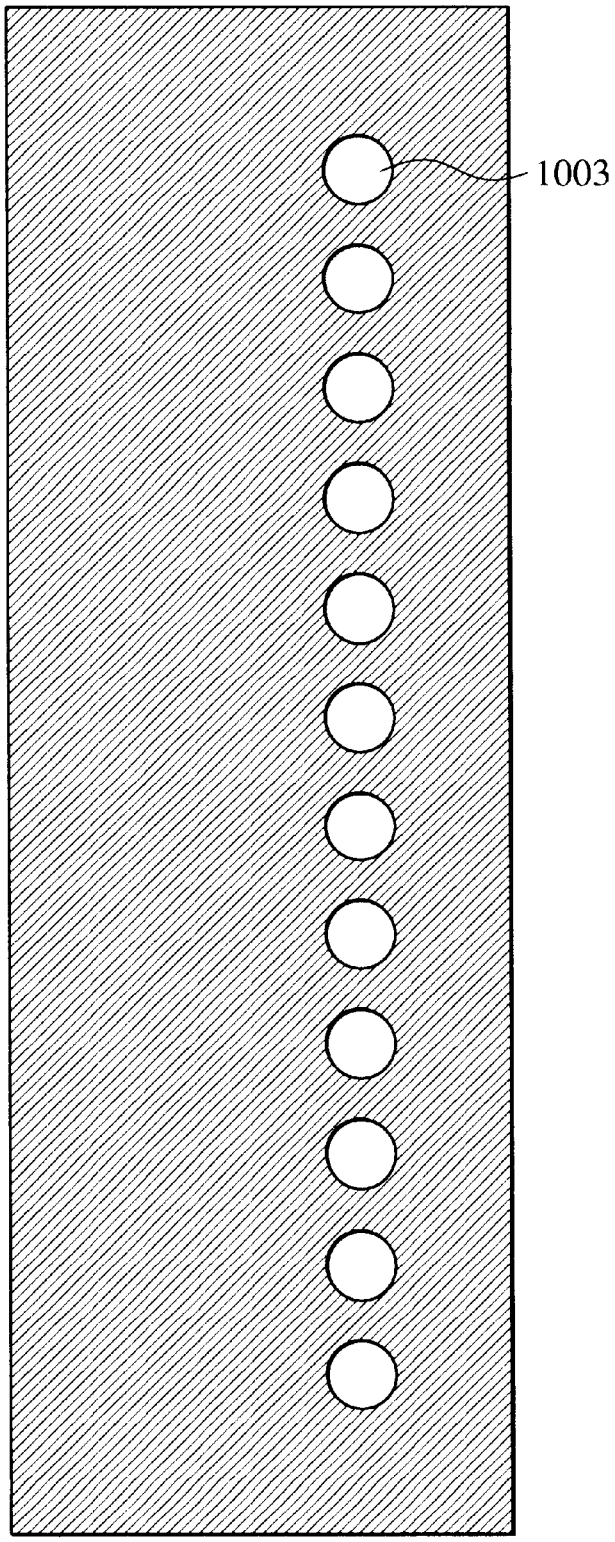
FIG. 12 is a sectional view of the ink-jet head shown in FIG. 6, taken along the plane F in FIG. 9.

FIG. 6 is a bottom perspective view of the ink-jet head 1000, FIG. 7 is a perspective view showing the interior of the ink-jet head 1000, FIG. 8 is a sectional view of the ink-jet head 1000, taken in the direction perpendicular to the direction in which nozzles are arranged, FIG. 9 is a sectional view of the ink-jet head 1000, taken in the direction in which the nozzles are arranged, and FIGS. 10 to 12 are sectional views of the ink-jet head 1000, taken along the planes in parallel with a recording sheet P. FIG. 10 is a cross sectional view taken at a portion D in FIG. 9, FIG. 11 is a cross sectional view taken at a portion E, and FIG. 12 is a cross section view taken at a portion F.

Referring to these figures, a plurality of ink discharge openings 1003 are arranged in the feeding direction of a recording sheet P serving as a printing medium on a surface of the ink-jet head 1000 opposing the recording sheet P. In the ink-jet head 1000, ink channels 1005 communicate with the discharge openings 1003, and electrothermal conversion elements (discharge heaters) 1002 for generating heat energy used to discharge ink are disposed corresponding to the ink channels 1005. Each of the discharge heaters 1002 generates heat by receiving an electrical pulse according to driving data, and causes film boiling in the ink. The ink is discharged from the discharge opening 1003 by using a bubble produced by the film boiling as motive power. A common ink chamber 1001 commonly communicates with the ink channels 1005, and is connected to the ink tank IT.

First Embodiment

A driving method for the ink-jet head according to a first embodiment of the present invention will be described with reference to FIGS. 13 to 22.

Figure 13A:
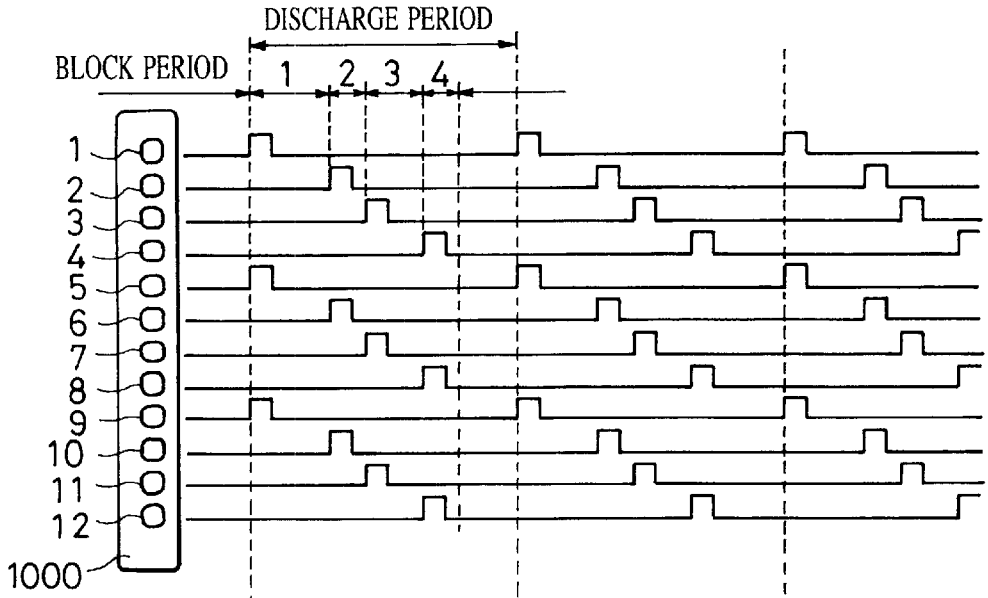
FIGS. 13A to 13C show a driving method for an ink-jet head according to a first embodiment of the present invention.

FIG. 13A shows the correspondence between nozzles arranged in the ink-jet head 1000, and the waveforms of signals to be applied to the discharge heaters mounted in the nozzles. In this figure, the ink-jet head 1000 has twelve nozzles 1 to 12 arranged in numerical order from the top for ease of explanation.

A timing chart shown on the right side of the ink-jet head 1000 in FIG. 13A shows the waveforms of signals to be applied to the discharge heaters in the nozzles. The vertical axis represents the applied voltage. A state in which the voltage is high (H) means an energized (ON) state, and a state in which the voltage is low (L) means a non-energized (OFF) state. The horizontal axis represents the time.

The nozzles 1 to 12 are divided into four groups (blocks) of three. When the applied voltage is high, the discharge heater of the nozzle is energized and generates heat, and ink is discharged by using the expansion power of a bubble generated by the heat. In contrast, when the voltage is low, the discharge heater is not energized, and ink is not discharged. The nozzles 1 to 12 are driven in a time division manner, that is, the nozzles 1, 5, and 9 are driven at a first block time, the nozzles 2, 6, and 10 at a second block time, the nozzles 3, 7, and 11 at a third block time, and the nozzles 4, 8, and 12 at a fourth block time. As a result, the discharge openings of the first to fourth blocks sequentially perform discharging operations. As shown in FIG. 13A, the driving periods 1 to 4 assigned to the first to fourth blocks, that is, a period between the beginning of the driving of a block and the beginning of the driving of the next block (hereinafter referred to as "block periods") are determined so that they are not equal. In this embodiment, the block periods are determined at random.

Figure 13B:
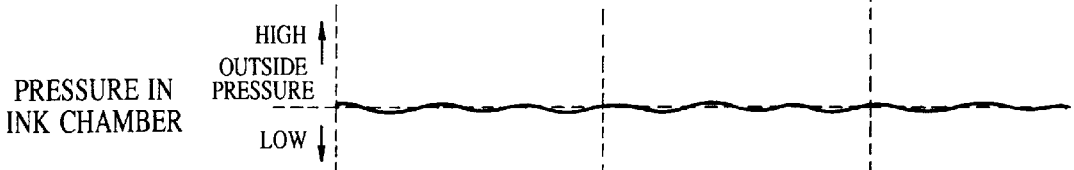

FIG. 13B shows the changes in pressure inside an ink chamber of the ink-jet head due to the driving of the discharge heaters or the discharging operations of the nozzles described above. The vertical axis represents the pressure, and the horizontal axis represents the time. A broken line along the horizontal axis shows the pressure equal to the outside pressure. A part over the broken line shows that the pressure inside the ink chamber is high, and a part under the broken line shows that the pressure is low. In this embodiment, since the block periods are random, as shown in FIG. 13A, frequency components of a pressure wave in the ink chamber are dispersed.

Figure 13C:
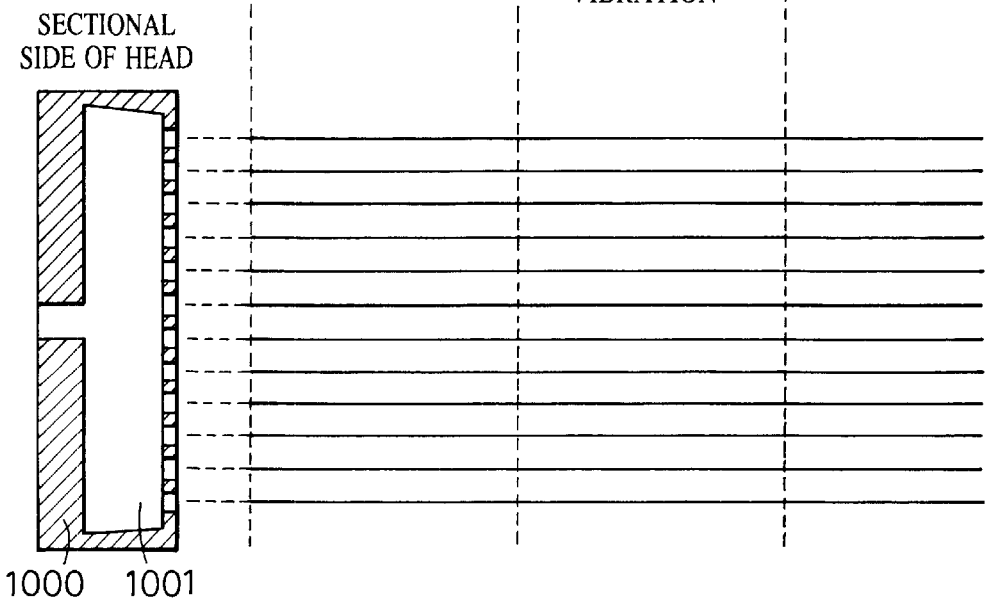

FIG. 13C shows the sectional side of the ink-jet head of this embodiment, and the states of meniscus vibrations caused at the discharge openings of the nozzles. The vertical axis represents the states of a contact surface (meniscus surface) between the ink at the discharge opening and air. A state in which a meniscus surface is placed on a broken line corresponding to the discharge opening shows a normal state. As the meniscus surface becomes higher than in this state, it becomes more convex toward the outside of the discharge opening. Conversely, as the meniscus surface becomes lower than in this state, it becomes more concave toward the inside of the discharge opening. In this embodiment, since the frequency components of the pressure wave in the ink chamber are dispersed and resonance of the meniscus surfaces is suppressed by setting the block periods at random, meniscus vibration is substantially avoided.

In this embodiment, the nozzles are driven in four groups (blocks) for ease of explanation and for a simpler circuit configuration when carrying out the invention. That is, the main feature of the present invention is to disperse the frequency components of the pressure wave in the ink chamber. For that purpose, the number of nozzles and the number of blocks may be appropriately determined. For example, the ON time may be determined for each nozzle, or the number of groups may be different from four.

Figure 14:
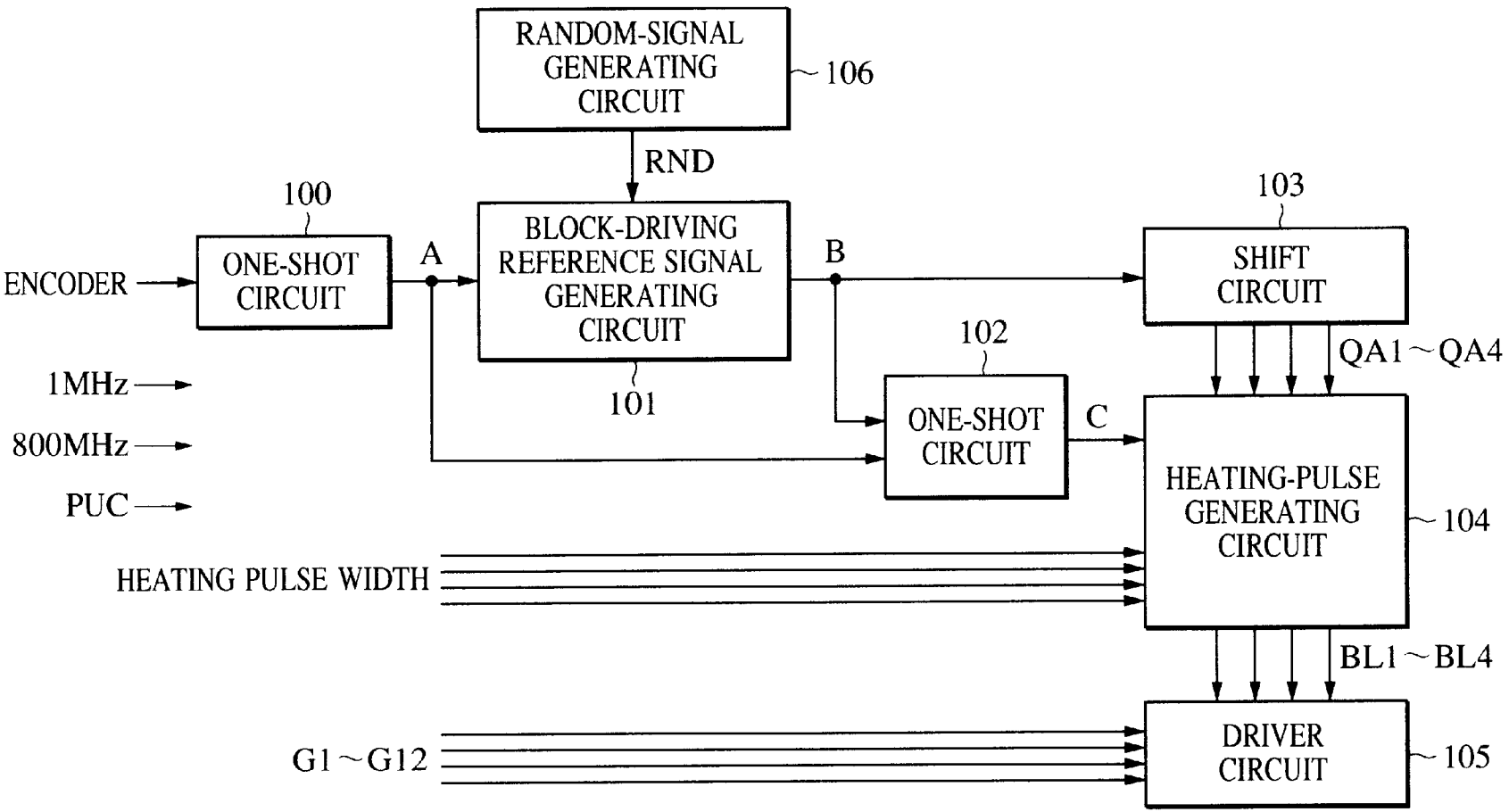
FIG. 14 is a block diagram showing the configuration of a driving circuit for time-division printing in the ink-jet head.
Figure 15:
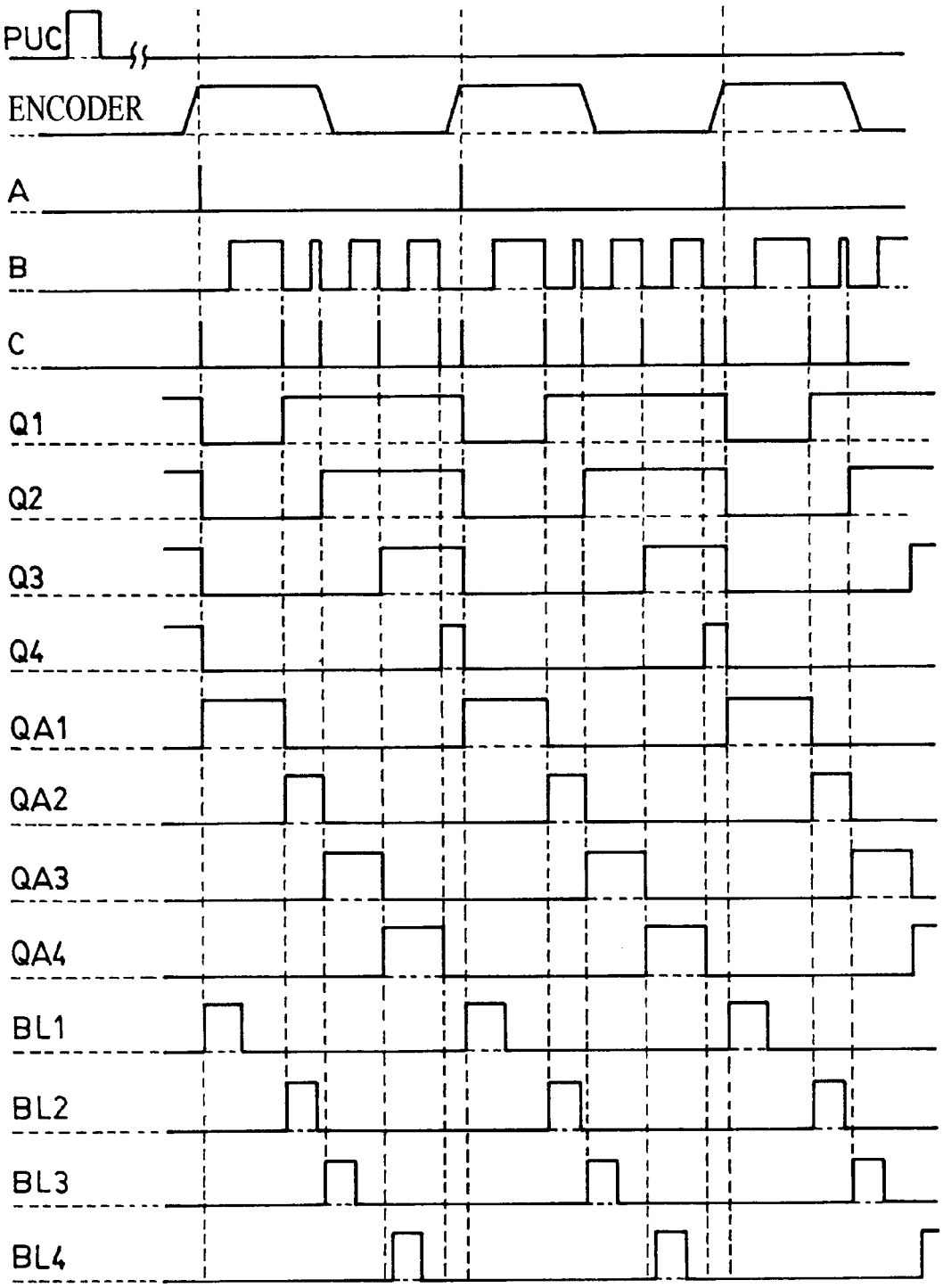
FIG. 15 is a timing chart of the components of the driving circuit shown in FIG. 14.

FIG. 14 is a circuit diagram showing the configuration of a driving circuit for performing time-division driving in which the block periods are random. FIG. 15 is an operation timing chart of the components of the driving circuit.

Referring to FIG. 14, a one-shot circuit 100 detects the rising edge of a determined encoder signal, and generates a one-shot pulse signal A. Encoder signals are output from the encoder 206 which detects the slits formed at regular intervals in the linear scale 207 while the carriage 200 with the ink-jet head 1000 mounted thereon moves in the main scanning direction. When the carriage 200 performs main scanning at a constant speed, encoder signals are generated at regular intervals. The one-shot pulse signal A is supplied parallel to a block-driving reference signal generating circuit 101 and a one-shot circuit 102.

Figure 16A:
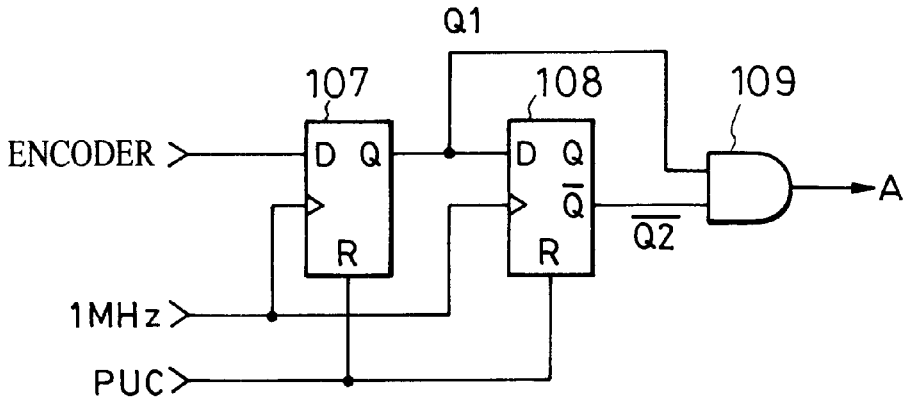
FIG. 16A is a circuit diagram of a one-shot circuit shown in FIG. 14.
Figure 16B:
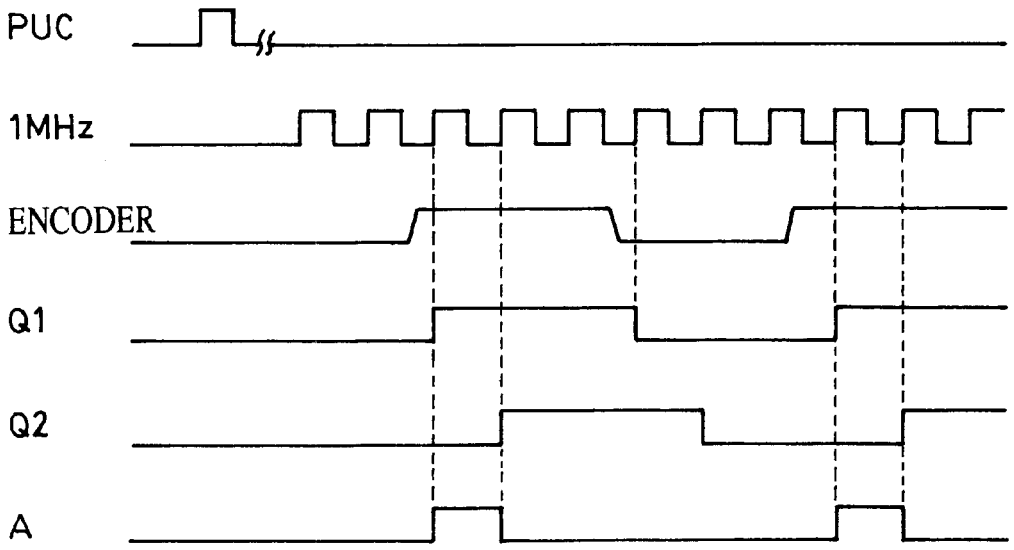
FIG. 16B is a timing chart of the components of the one-shot circuit.

The configuration and operation of the one-shot circuit 100 will now be described with reference to FIGS. 16A and 16B. FIG. 16A is a circuit diagram of the one-shot circuit 100, and FIG. 16B is an operation timing chart thereof.

In FIG. 16A, delay flip-flops (delay bistable multivibrators which will be abbreviated as "DFFS" hereinafter) 107 and 108 each latch information which is input to a terminal D in response to the rising edge of a clock signal of, for example, 1 MHz, and hold the information at an output terminal Q. In this case, a signal which is the inverse of the output of the terminal Q is held at an inverse output terminal /Q. When a high-level signal is input to a reset input terminal R of the DFF 107 or 108, the signal at the terminal Q becomes low, and the signal at the terminal /Q becomes high.

A signal PUC to be input to the input terminal R instantly becomes high when the power supply (not shown) is turned on, and becomes low when the power-supply circuit is brought into a stable state. Since the signal PUC is supplied to the input terminals R of the DFFs 107 and 108, the signal at the terminal Q of the DFF 107 becomes low and the signal at the terminal /Q of the DFF 108 becomes high immediately after the power supply is turned on.

A square wave of 1 MHz is input to clock terminals CK of the DFFS 107 and 108. Since an encoder signal is input to the input terminal D of the DFF 107, a signal Q1 output from the terminal Q of the DFF 107 changes in synchronization with the clock signal of 1 MHz. Since the output terminal Q of the DFF 107 is connected to the input terminal D of the DFF 108, a signal /Q2 output from the DFF 108 changes after a delay of 1 clock from the signal Q1 from the terminal D of the DFF 107. In this case, since the clock signal of 1 MHz is used, the delay of 1 clock corresponds to 1 $\mu$s. An AND gate 109 outputs a signal A which is the AND between the signal Q1 output from the terminal Q of the DFF 107 and the signal /Q2 output from the terminal /Q of the DFF 108. With the above configuration, the one-shot circuit 100 outputs a signal A which is high for only 1 $\mu$s at the rising edge of the encoder signal.

Referring again to FIG. 14, the block-driving reference signal generating circuit 101 is reset by a pulse signal A, and generates a pulse signal B at random timing. The signal B is input to a shift circuit 103 and a heating-pulse generating circuit 104. The signal B serves as a reference signal for the block periods shown in FIG. 13A. While the pulse signal B has a constant pulse width in the related art, it has a random pulse width in this embodiment.

Figure 4A:
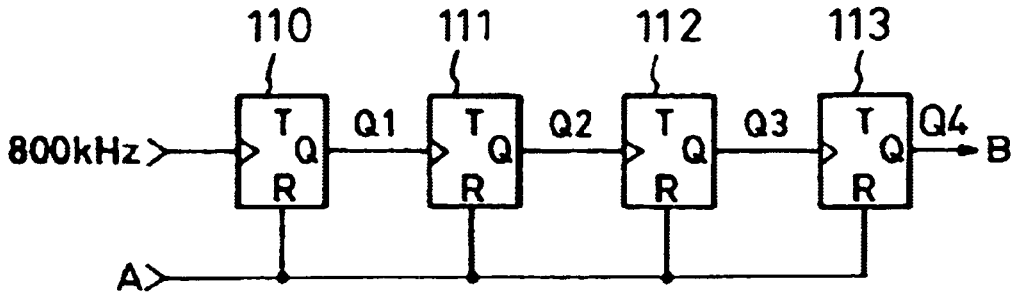
FIG. 4A is a circuit diagram showing the configuration of a timer circuit shown in FIG. 2.
Figure 4B:
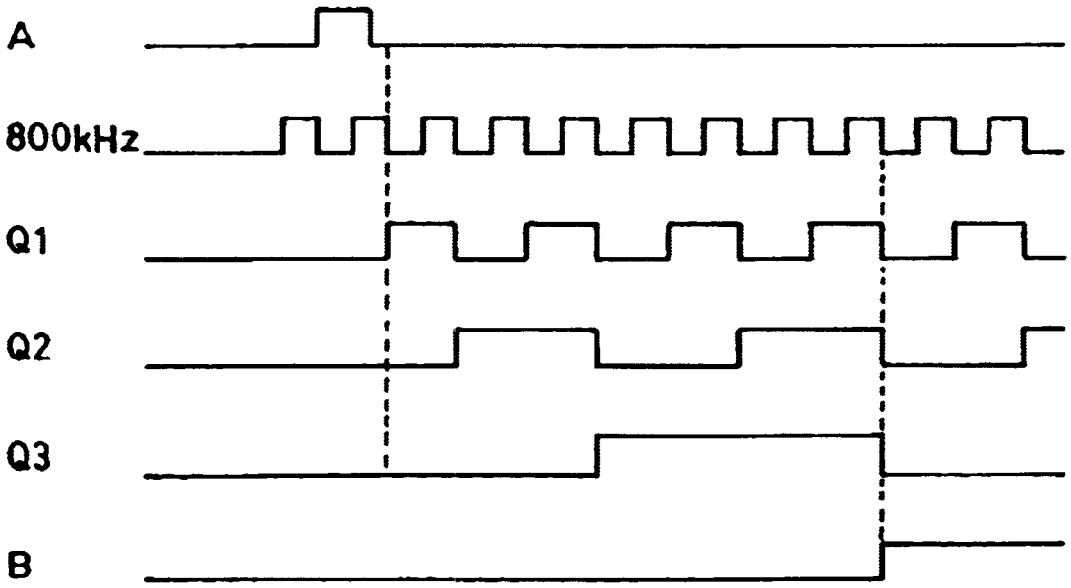
FIG. 4B is an operation timing chart of the timer circuit.
Figure 17A:
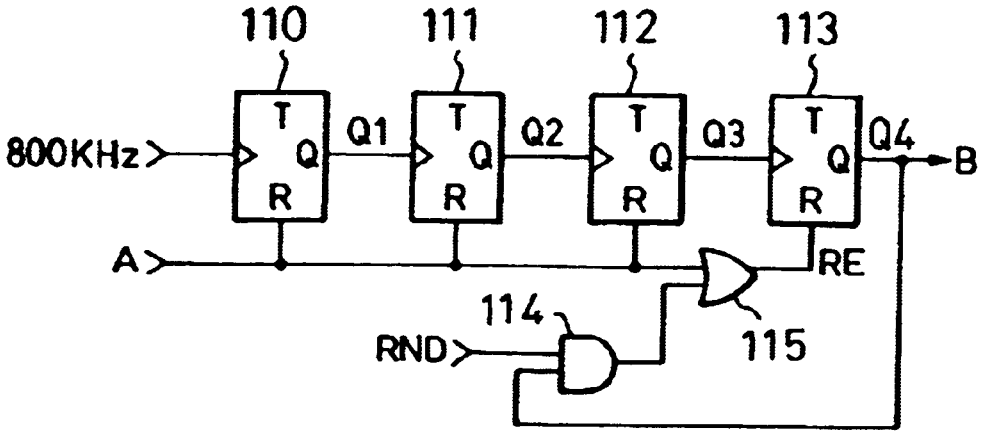
FIG. 17A is a circuit diagram showing the configuration of a block-driving reference signal generating circuit shown in FIG. 14, and FIGS. 17B and 17C are timing charts of the components of the block-driving reference signal generating circuit.
Figure 17B:
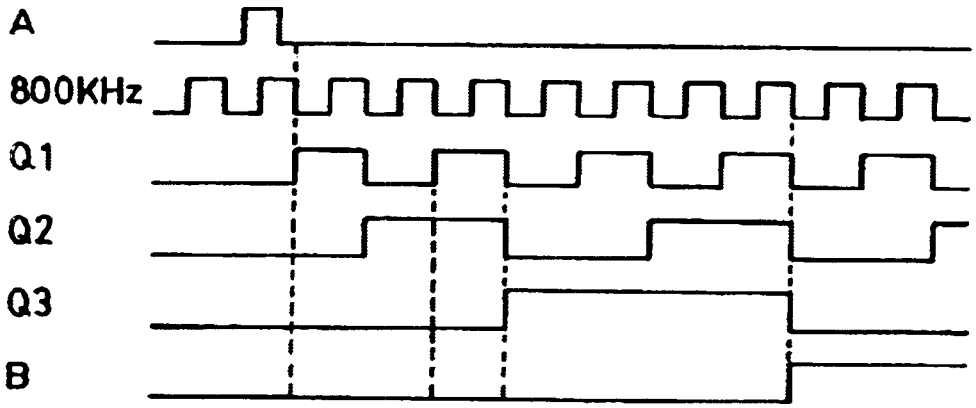
Figure 17C:
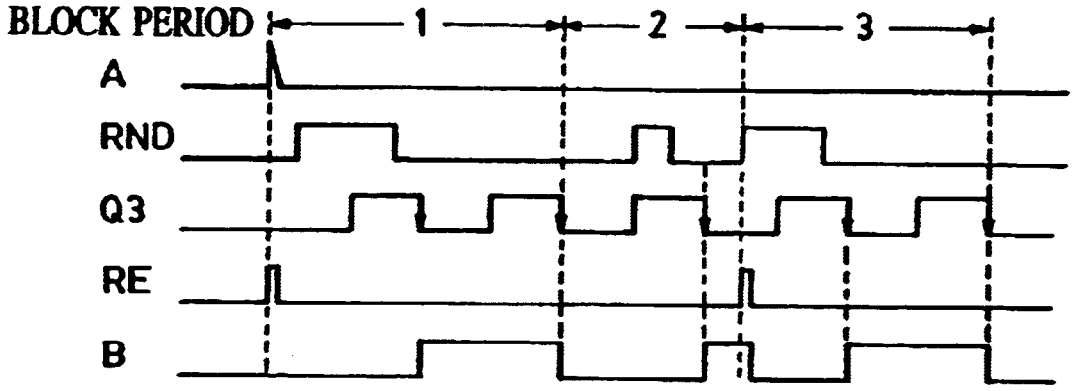

The block-driving reference signal generating circuit 101 will now be described in detail with reference to FIGS. 17A to 17C. FIG. 17A is a circuit diagram of the block-driving reference signal generating circuit 101, and FIGS. 17B and 17C are operation timing charts thereof. TFFs 110 to 113, which are connected in series in a manner similar to that in FIG. 4, each divide a signal input to a clock input terminal CK, and hold the signal at an output terminal Q. When the signal A is high, a high-level signal is input to input terminals R of all the TFFs 110 to 113, and therefore, signals Q1, Q2, Q3, and Q4 output therefrom become low (reset). That is, the TFFs 110 to 113 are reset at the rising edge of the encoder signal.

When it is assumed that a square wave of, for example, 800 kHz is input to the TFF 110, it is divided into a signal Q1 of 400 kHz, a signal Q2 of 200 kHz, and a signal Q3 of 100 kHz. The signal Q3 is input to the TFF 113, and a signal B of 50 kHz is output after dividing. The output signal B is also input to one input terminal of an AND gate 114.

In a case in which the output signal B is high, when a signal RND supplied to the other input terminal of the AND gate 114 is high, the output of the AND gate 114 is high. The output terminal of the AND gate 114 is connected to an OR gate 115. When a high-level signal is input from the AND gate 114 to the OR gate 115, the output of the OR gate 115 is also high, thereby resetting the TFF 113.

In this way, the signal B becomes high 10 $\mu$s after the rising edge of the signal A. Then, when the signal RND becomes high within another 10 $\mu$s, the TFF 113 is reset. The signal B varies within the range of 10 $\mu$s to 20 $\mu$s. The signal B serves as a reference signal for the block periods in this embodiment.

The signal RND is output from a random-signal generating circuit 106 shown in FIG. 14. This signal switches between the high level and the low level at random, and may also be generated by, for example, using a random (RND) function in a microcomputer.

Figure 18:
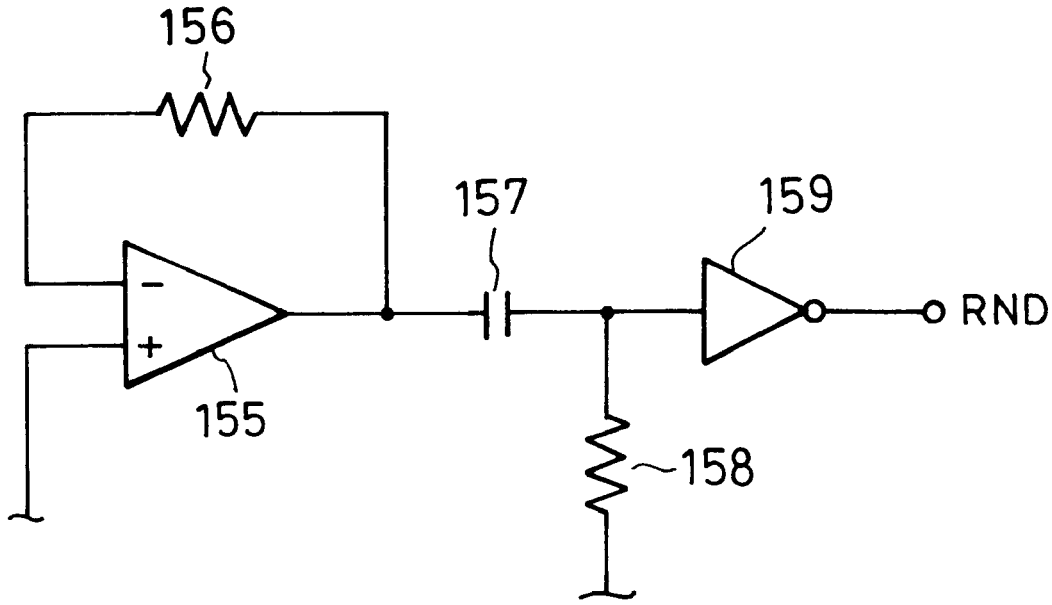
FIG. 18 is a circuit diagram of a random-signal generating circuit which is applicable to the circuits shown in FIGS. 14 to 17A.

As shown in FIG. 18, in the random-signal generating circuit 106, an input terminal "+" of an operational amplifier 155 is connected to a reference voltage, and a high value resistor 156 is connected between an input terminal "−" and an output terminal thereof. The output terminal of the operational amplifier 155 may be connected to a NOT circuit 159 via a capacitor 157. That is, since the high value resistor 156 outputs white noise (random noise), a random signal may be generated by amplifying the white noise by the operational amplifier 155 and inputting the noise to the NOT circuit 159 via the capacitor 157. One terminal of a resistor 158 is connected to a reference voltage.

Referring to FIGS. 14 and 15, the one-shot circuit 102 generates a one-shot pulse signal at the falling edge of the signal B, and outputs an OR signal C between the one-shot pulse signal and the pulse signal A. The signal C is supplied to the heating-pulse generating circuit 104.

Figure 19A:
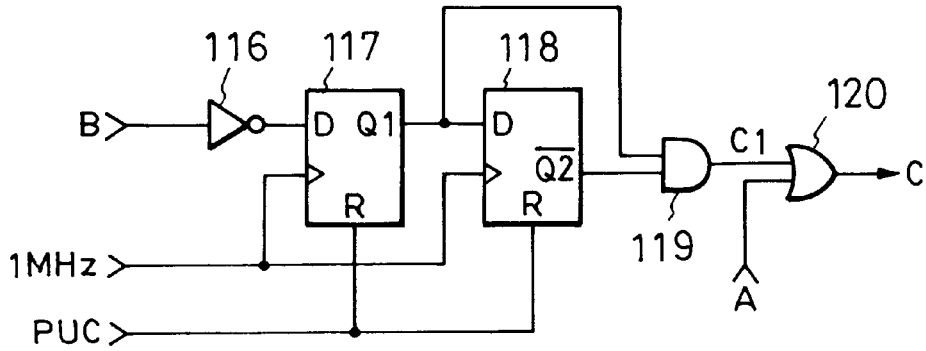
FIG. 19A is a circuit diagram showing the configuration of another one-shot circuit shown in FIG. 14.
Figure 19B:
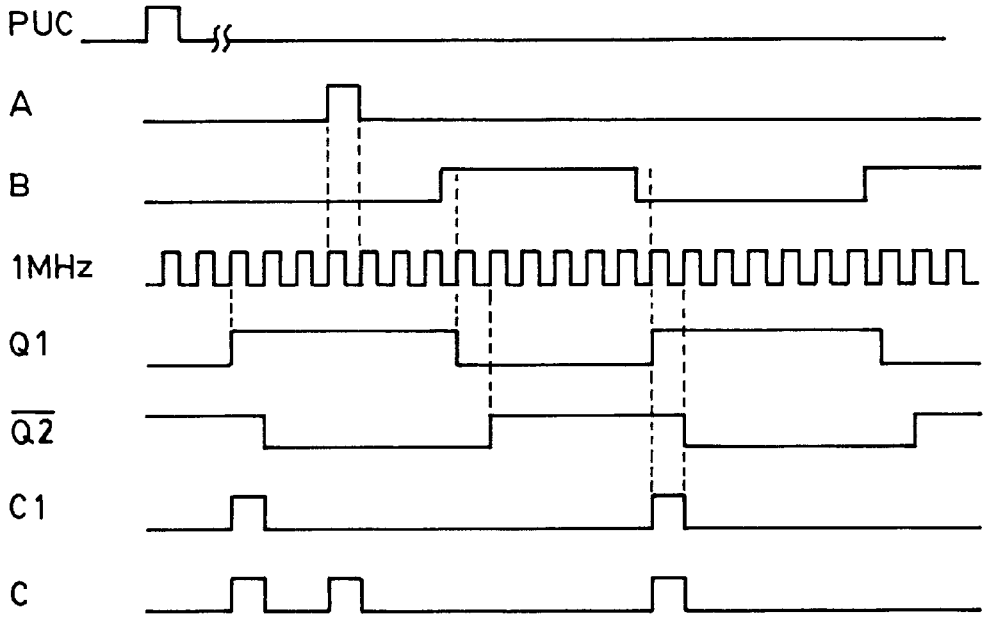
FIG. 19B is a timing chart of the components of the one-shot circuit.

The one-shot circuit 102 will be described in detail with reference to FIGS. 19A and 19B. FIG. 19A is a circuit diagram of the one-shot circuit 102, and FIG. 19B is an operation timing chart thereof. In FIG. 19A, DFF 117, whose terminal D is connected to the output of a NOT circuit 116, and DFF 118 each latch information input to a terminal D at the rising edge of a clock signal CK, and hold the information at an output terminal Q1 and /Q2. In this case, a signal which is the inverse of the signal Q1 is output to a terminal /Q2. A reset signal PUC is input to input terminals R of the DFFs 117 and 118. When a H-level signal is input to the input terminals R, the signal Q at the terminal Q1 becomes low, and the signal at the terminal /Q2 becomes high.

A signal PUC instantly becomes high only during an unstable period when the power supply (not shown) is turned on and a power-supply circuit is energized, and becomes low during a stable period. Since the signal PUC is supplied to the input terminals R of the DFFs 117 and 118, the signal at the terminal Q1 of the DFF 117 is low and the signal at the terminal /Q2 of the DFF 118 is high immediately after the power is turned on.

A square wave of 1 MHz is input to clock input terminals CK of the DFFs 117 and 118. Since an encoder signal is input to an input terminal D of the DFF 117, the terminal Q1 outputs an encoder signal which changes in synchronization with the clock signal of 1 MHz. Since the output terminal Q1 of the DFF 117 is connected to an input terminal D of the DFF 118, a signal output from the DFF 118 changes after a delay of 1 clock from the signal from the terminal Q1 of the DFF 117. In this case, since the clock signal of 1 MHz is used, the delay of 1 clock corresponds to 1 μs. An AND gate 119 outputs an AND signal C1 between the signal from the terminal Q1 of the DFF 117 and the signal from the terminal /Q2 of the DFF 118. An OR gate 120 outputs an OR signal C between the signal C1 and the signal A. With the above configuration, the one-shot circuit 102 outputs the OR signal C between the signal C1, which is high for only 1 μs at the falling edge of the block reference signal B, and the signal A which is high for only 1 μs at the rising edge of the encoder signal. The signal C serves as an energization start timing signal for the discharge heater, and the period of one shot of the signal C serves as a block period.

Referring to FIGS. 14 and 15, the shift circuit 103 outputs pulse signals QA1 to QA4 in response to the signal B, and inputs the signals to the heating-pulse generating circuit 104.

Figure 20A:
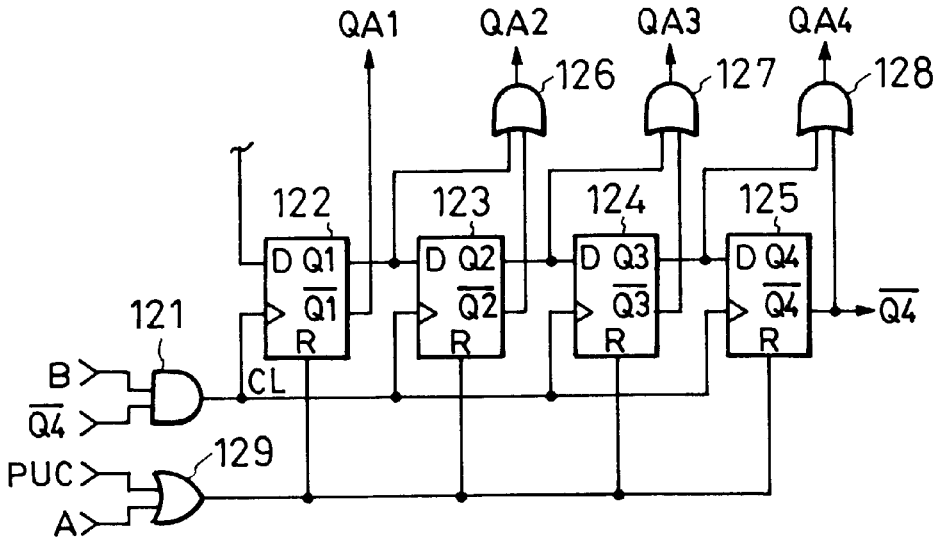
FIG. 20A is a circuit diagram showing the structure of a shift circuit shown in FIG. 14.
Figure 20B:
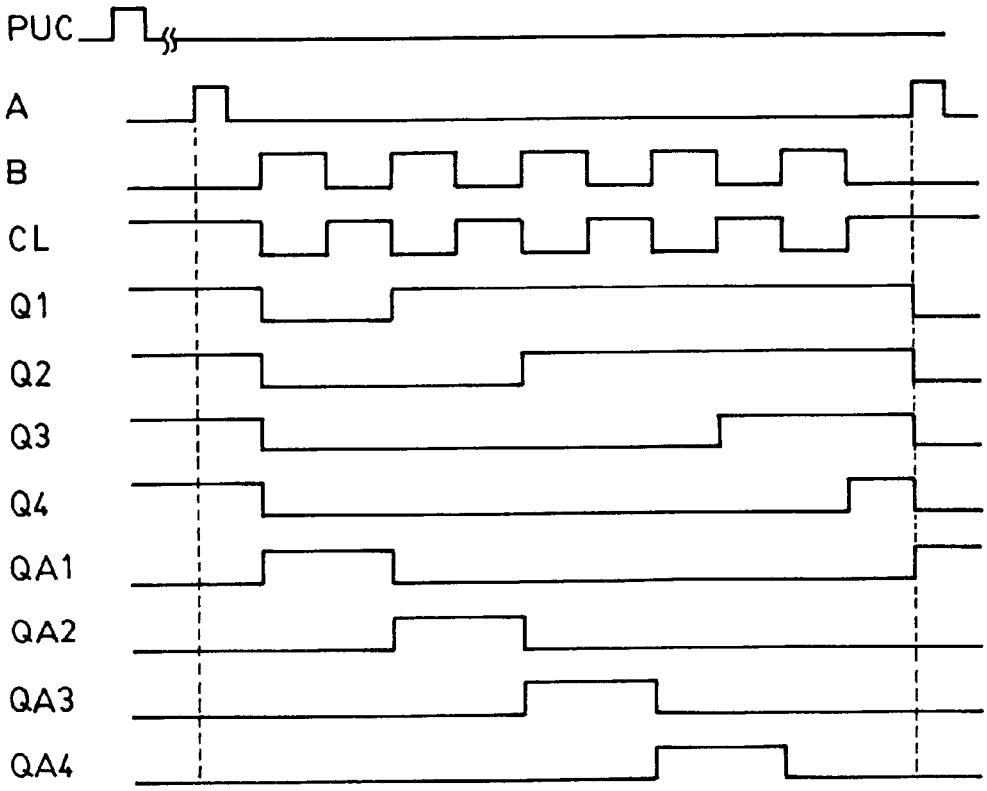
FIG. 20B is a timing chart of the components of the shift circuit.

The shift circuit 103 will be described in detail with reference to FIGS. 20A and 20B. FIG. 20A is a circuit diagram of the shift circuit 103, and FIG. 20B is an operation timing chart thereof. In FIG. 20A, reference numerals 122 to 125 denote DFFs. An input terminal D of the DFF 122 is pulled up to the H level. An output terminal Q1 of the DFF 122 is connected to an input terminal D of the DFF 123, an output terminal Q2 of the DFF 123 is connected to an input terminal D of the DFF 124, and an output terminal Q3 of the DFF 124 is connected to an input terminal D of the DFF 125. That is, the shift circuit 103 is configured like a so-called shift register.

An OR gate 129 outputs an OR signal between a signal PUC which serves as a reset signal from the time the power-supply circuit is turned on until when a stable state is established, and a signal A output from the one-shot circuit 100. Since the signal is input to reset input terminals of the DFFs 122 to 125, the DFFs 122 to 125 are reset when the power is turned on and in response to the signal A (at every rising edge of the encoder signal), and the output signals of the terminals Q become low.

An AND signal between a signal, which is the inverse of the signal B output from the block-driving reference signal generating circuit 101, and a signal output from a terminal /Q4 of the DFF 125 is input from an AND gate 121 to input terminals CK of the DFFs 122 to 125. At the rising edge of the encoder signal, the one-shot circuit 100 outputs a one-shot signal A, and the DFFs 122 to 125 are reset. In this case, since the signal /Q4 is high, a signal which is the inverse of a signal B is input to the terminals CK of the DFFs 122 to 125. The signal Q1 becomes high at the first falling edge of the signal B, the signal Q2 becomes high at the second falling edge, and the signal Q3 becomes high at the third falling edge. When the signal Q4 becomes high at the fourth falling edge, an inverse signal /Q4 (low-level) is input to the AND gate 121. Consequently, the clock terminals CK of the DFFs 122 to 125 are stopped, and the DFFs 122 to 125 hold their outputs.

AND gates 126 to 128 calculate the AND between the output Q1 of the DFF 122 and the inverse output /Q2 of the DFF 123, the AND between the output Q2 of the DFF 123 and the inverse output /Q3 of the DFF 124, and the AND between the output Q3 of the DFF 124 and the inverse output /Q4 of the DFF 125, and outputs signals QA2, QA3, and QA4. These signals QA2, QA3, and QA4 are reset at the rising edge of the encoder signal, and only a signal QA1 which is equal to the output from the terminal Q1 of the DFF 122 becomes high. At every falling edge of the signal B, the signals QA2, QA3, and QA4 are sequentially shifted to the high level. The signals QA1, QA2, QA3, and QA4 represent the block periods.

Referring to FIGS. 14 and 15, the heating-pulse generating circuit 104 generates signals for energizing the discharge heaters, and outputs the signals to a driver circuit 105. Information about the energizing periods of the discharge heaters for discharging ink is supplied from a microcomputer or the like (not shown) which serves as a control section in the printing apparatus. The energizing periods (heating pulse width) of the discharge heaters are defined on the basis of the information. As shown in FIG. 15, the heating-pulse generating circuit 104 outputs a block-driving signal BL1 only for the period defined by the information at the rising edge of the pulse signal QA1, and supplies the block-driving signal BL1 to the driver circuit 105. Similarly, the heating-pulse generating circuit 104 outputs block-driving signals BL2, BL3, and BL4 only for the periods defined by the information at the rising edges of the pulse signals QA2, QA3, and QA4, respectively, and supplies the block-driving signals BL2, BL3, and BL4 to the driver circuit 105.

Figure 21A:
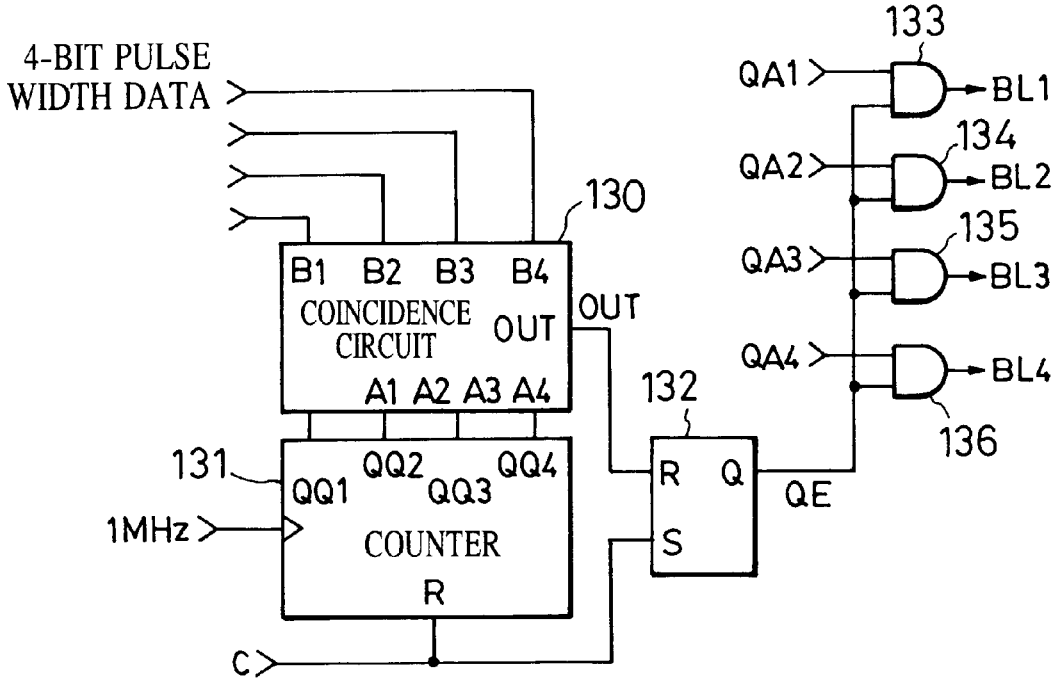
FIG. 21A is a circuit diagram showing the configuration of a heating-pulse generating circuit shown in FIG. 14.
Figure 21B:
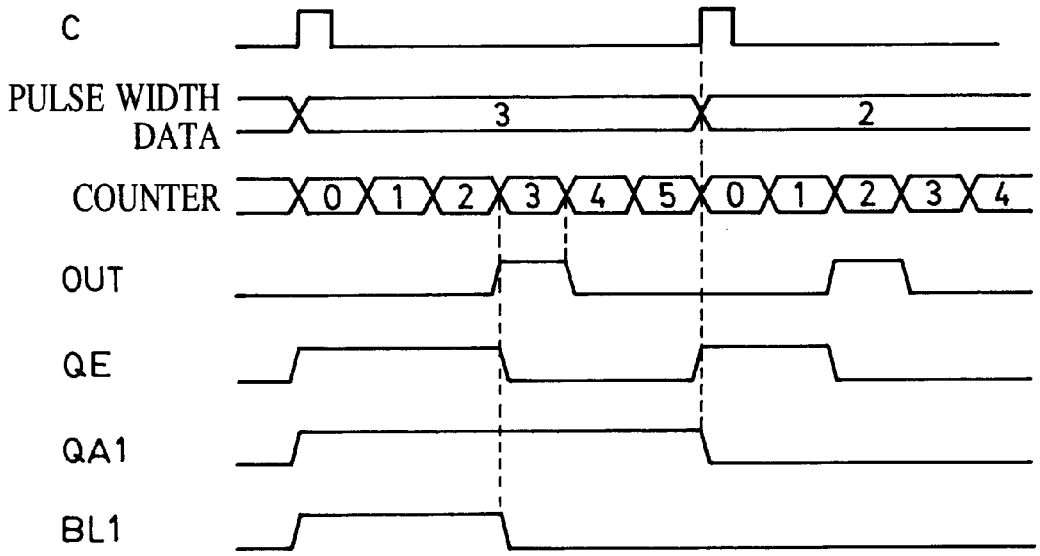
FIG. 21B is a timing chart of the components of the heating pulse generating circuit.

The heating-pulse generating circuit 104 will be described in detail with reference to FIGS. 21A and 21B. FIG. 21A is a circuit diagram of the heating-pulse generating circuit 104, and FIG. 21B is an operation timing chart thereof. In these figures, a counter 131 counts square waves of 1 MHz, and outputs signals which are counted up in binary number system every microsecond, via output terminals QQ1, QQ2, QQ3, and QQ4.

A 4-bit coincidence circuit 130 compares 4-bit signals input to terminals A1, A2, A3, and A4 connected to the terminals QQ1, QQ2, QQ3, and QQ4 and 4-bit signals input to terminals B1, B2, B3, and B4. When the A-signals and the B-signals completely coincide with each other, a signal OUT output from the coincidence circuit 130 is high. In other cases, the signal OUT is low. That is, the signals B1, B2, B3, and B4 showing the pulse width and the signals QQ1, QQ2, QQ3, and QQ4 which are counted up every microsecond are compared. When the signals B1, B2, B3, and B4 and the signals QQ1, QQ2, QQ3, and QQ4 coincide with each other, the signal OUT becomes high.

A set reset flip-flop (hereinafter abbreviated as "SRFF") 132 outputs a high-level signal QE when a signal input to a set terminal S is high and a signal input to a reset terminal R is low, outputs a low-level signal QE when the signal to the terminal S is low and the signal to the terminal R is high, and holds the signal QE (unchanged) when the signal to the terminal S is low and the signal to the terminal R is low. A state in which the signal to the terminal S is high and the signal to the terminal R is high is prohibited.

The above-described signal C is supplied to a reset input terminal R of the counter 131 and the set input terminal S of the SRFF 132. The counter 131 is reset at the one-shot timing of the signal C, and the signal QE from the SRFF becomes high. Since a terminal OUT of the counter 131 and the input terminal R of the SRFF, the signal QE becomes low after the periods shown by the signal B1 to B4 representing the data on the discharge heater pulse width pass.

The signals QA1 to QA4 are block signals, as described above. AND gates 133 to 136 output AND signals BL1 to BL4 between the signals QA1 to QA4 and the signal QE. The signals BL1 to BL4 represent the energization timings for the discharge heaters in the blocks, respectively.

Referring to FIGS. 14 and 15, the driver circuit 105 supplies driving signals to the discharge heaters corresponding to the nozzles which should discharge ink, according to image information. Signals G1 to G12 (signals which determine which nozzles discharge ink) are supplied to the driver circuit 105 according to the image information. The signals G1 to G12 are input from the control section (not shown). That is, the driver circuit 105 outputs driving signals for the discharge heaters, which are permitted by the signals G1 to G12, in response to the block driving signals BL1 to BL4.

Figure 22:
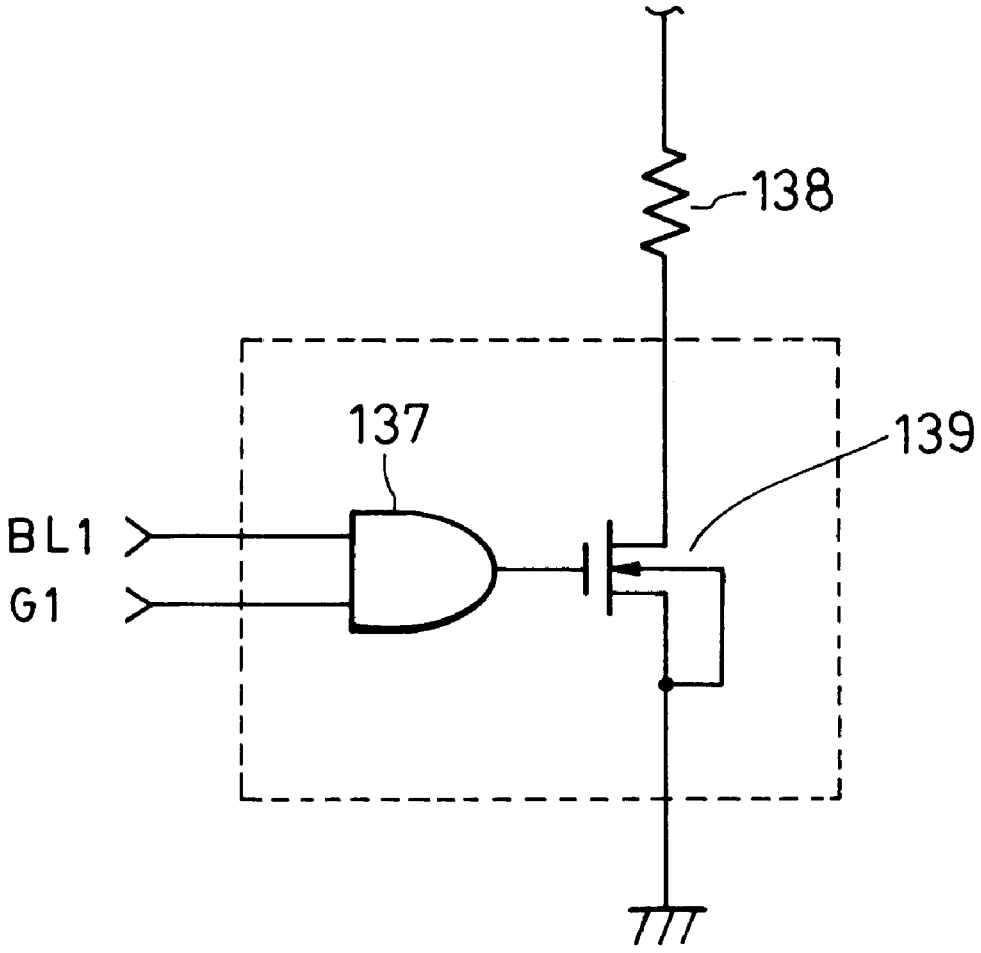
FIG. 22 is a circuit diagram showing the configuration of a driver circuit shown in FIG. 14.

FIG. 22 shows a detailed configuration of the driver circuit 105. An AND gate 137 calculates an AND signal between the signal BL1 and the signal G1, and an output terminal thereof is connected to a gate of an N-channel MOS FET 139. A discharge heater 138 is connected to a discharge heater power supply at one end, and to a drain of the MOS FET 139 at the other end. A source of the MOS FET 139 is connected to the ground of the power supply. The MOS FET 139 forms a switching element for the discharge heater 138. When the gate thereof is low, an OFF state is established, and the resistance between the drain and the source is high (several gigaohms or more). When the gate is high, an ON state is established, and the resistance between the drain and the source is low (several ohms or less). A current passes from the discharge heater power supply to the ground via the discharge heater 139, the drain, and the source, thereby causing the discharge heater 139 to generate heat. By using a bubble forming phenomenon caused by the heat generation, ink is discharged.

While the N-channel MOS FET is used as the switching element for the discharge heater in this embodiment, it may be replaced with, for example, an NPN transistor, an IGBT (insulated gate bipolar transistor), or an SIT (static induction transistor). When the switching element is connected to the power supply and the discharge heater is connected to the ground, a P-channel MOS FET or a PNP transistor may be used.

While FIG. 22 shows the driver circuit for a single discharge heater (corresponding to a single nozzle), a number of similar driver circuits corresponding to the number of nozzles are mounted. That is, the energization of the discharge heaters of the nozzles 1, 2, 3, and 4 is controlled according to AND signals between the block driving signals BL1, BL2, BL3, and BL4 and image signals G1, G2, G3, and G4, respectively. Similarly, the energization of the discharge heaters of the nozzles 5, 6, 7, and 8 is controlled according to AND signals between the block driving signals BL1, BL2, BL3, and BL4 and image signals G5, G6, G7, and G8, and the energization of the discharge heaters of the nozzles 9, 10, 11, and 12 is controlled according to AND signals between the block driving signals BL1, BL2, BL3, and BL4 and image signals G9, G10, G11, and G12.

In this embodiment, the block periods defined by the block driving signals BL1, BL2, BL3, and BL4 are set to be different from one another. Therefore, the frequency components in the pressure wave in the ink chamber are dispersed, the meniscus surface does not resonate, and the meniscus vibration is suppressed. In particular, since the block periods are random, resonance of the meniscus surface can easily be suppressed.

While the above-driver circuit can be integrally mounted on a substrate on which the discharge heaters of the ink-jet head are formed, the other circuits shown in FIG. 14 may also be integrally mounted on the substrate or the ink-jet head.

A driving method for the ink-jet head according to a second embodiment of the present invention will be described with reference to FIGS. 23 to 25.

Figure 23A:
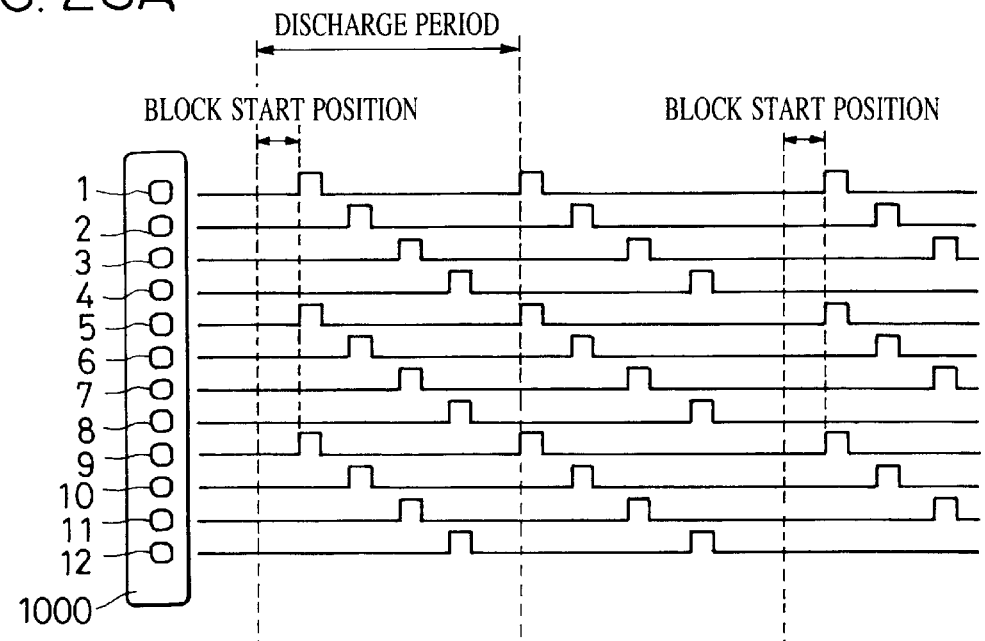
FIGS. 23A to 23C show a driving method for an ink-jet head according to a second embodiment of the present invention.

FIG. 23A shows the correspondence between nozzles arranged in the ink-jet head 1000, and the waveforms of signals to be applied to the discharge heaters mounted in the nozzles. In this figure, the ink-jet head 1000 has twelve nozzles 1 to 12 arranged in numerical order from the top for ease of explanation.

A timing chart shown on the right side of the ink-jet head 1000 in FIG. 23A shows the waveforms of signals to be applied to the discharge heaters in the nozzles. The vertical axis represents the applied voltage. When a high (H)-level voltage is applied, the discharge heater is energized (ON), and ink is discharged by using a bubble formed due to heat generation. When the voltage is low (L), the discharge heater is not energized (OFF), and ink is not discharged. The horizontal axis represents the time.

In a manner similar to that in the above first embodiment, the nozzles 1 to 12 are divided into four groups (blocks) of three. The nozzles 1 to 12 are driven in a time division manner, that is, the nozzles 1, 5, and 9 are driven at a first block time, the nozzles 2, 6, and 10 at a second block time, the nozzles 3, 7, and 11 at a third block time, and the nozzles 4, 8, and 12 at a fourth block time. As a result, the discharge openings of the first to fourth blocks sequentially perform discharging operations.

In this embodiment, block periods 1, 2, 3, and 4 are set to be equal, as shown in FIG. 23A. That is, the block periods are all equal. While the start point of the block driving in the discharge period is fixed, and the block periods are different in the first embodiment, the start point of the block driving within the driving period varies according to the discharge periods. In particular, the start point is changed at random in this embodiment.

Figure 23B:
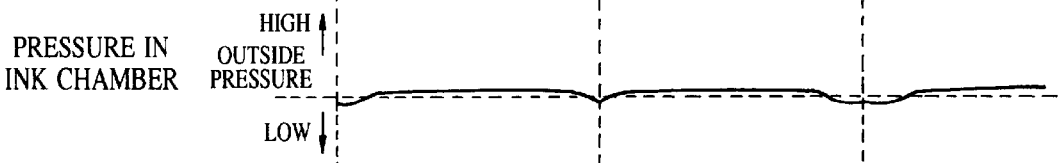

FIG. 23B shows the changes in pressure inside an ink chamber of the ink-jet head due to the driving of the discharge heaters or the discharging operations of the nozzles described above. The vertical axis represents the pressure, and the horizontal axis represents the time. A broken line along the horizontal axis shows the pressure equal to the outside pressure. A part over the broken line shows that the pressure inside the ink chamber is high, and a part under the broken line shows that the pressure is low. In this embodiment, since the start timing of the block driving changes at random, as shown in FIG. 23A, frequency components of a pressure wave in the ink chamber are dispersed.

Figure 23C:
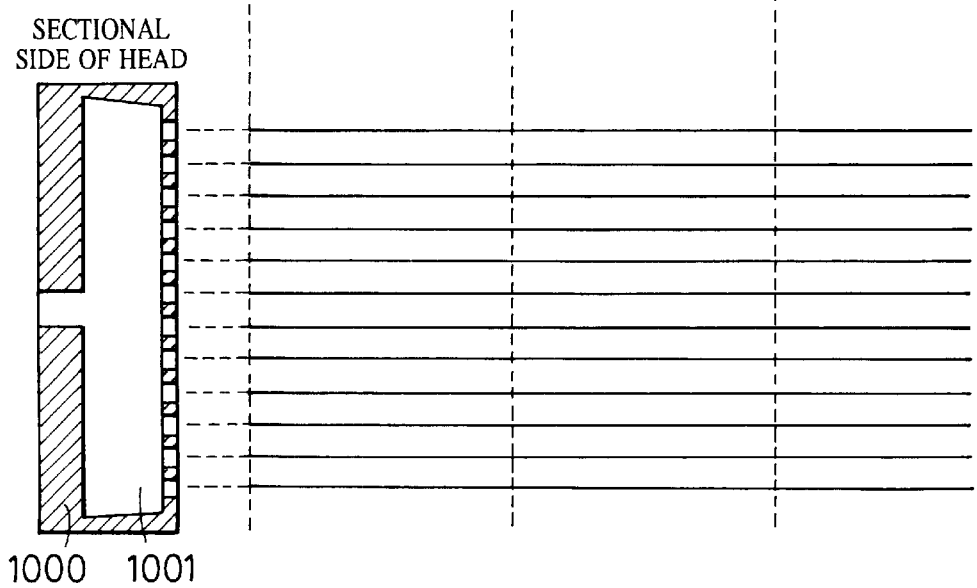

FIG. 23C shows the sectional side of the ink-jet head of this embodiment, and the states of meniscus vibrations caused at the discharge openings of the nozzles. The vertical axis represents the states of a contact surface (meniscus surface) between the ink at the discharge opening and air. A state in which a meniscus surface is placed on a broken line corresponding to the discharge opening shows a normal state. As the meniscus surface becomes higher than in this state, it becomes more convex toward the outside of the discharge opening. Conversely, as the meniscus surface becomes lower than in this state, it becomes more concave toward the inside of the discharge opening.

In this embodiment, since the period between the beginning of the discharge period and the start point of the block driving changes at random, the frequency components of the pressure wave in the ink chamber are dispersed, and resonance of the meniscus surface is suppressed, so that meniscus vibration is substantially avoided.

While a driving circuit for the above-described driving is basically similar to that in the first embodiment, it is different in the configurations of a one-shot circuit 100 and a block-driving reference signal generating circuit 101.

Figure 24A:
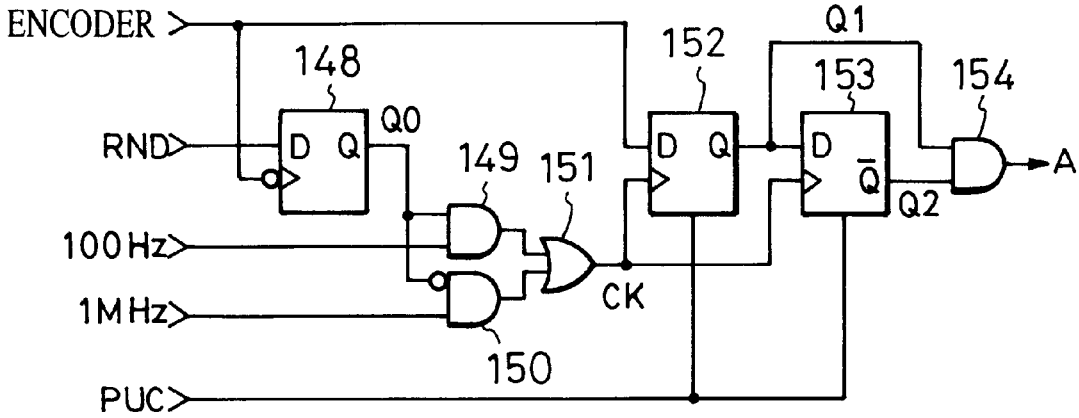
FIG. 24A is a circuit diagram showing the configuration of a one-shot circuit which is applicable to the driving method shown in FIGS. 23A to 23C.
Figure 24B:
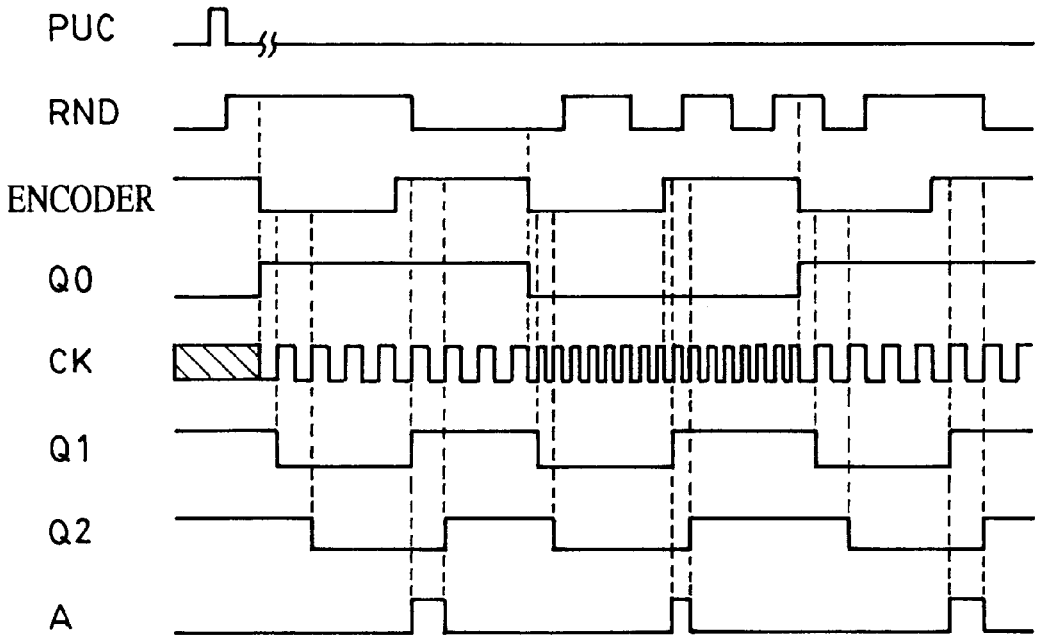
FIG. 24B is a timing chart of the components of the one-shot circuit.

FIG. 24A is a circuit diagram showing the configuration of the one-shot circuit 100, and FIG. 24A is an operation timing chart thereof. Reference numerals 148, 152, and 153 denote DFFs. A signal Q0 is obtained by latching a signal RND supplied from a random-signal generating circuit, which is similar to that in the first embodiment, by the DFF 148.

An AND gate 149, an AND gate 150, and an OR gate 151 constitute a selection circuit. For example, a square-wave signal of 100 kHz and a square-wave signal of 1 MHz are selectively output in response to the signal Q0. That is, a clock signal CK of 100 kHz or 1 MHz is output from the OR gate 151 according to the selection signal Q0.

The DFFs 152 and 153 and an AND gate 154 constitute a one-shot circuit. A one-shot pulse having a width equal to the width of the clock signal CK is output from the AND date 154 at every rising edge of an encoder signal. Since a signal PUC is input to the DFFs 152 and 153, a signal from a terminal Q of the DFF 152 becomes low and a signal from a terminal /Q of the DFF 153 becomes high immediately after the power is turned on.

A clock signal CK is input to clock terminals of the DFFs 152 and 153. Since an encoder signal is input to an input terminal D of the DFF 152, it is output from a terminal Q of the DFF 152 in synchronization with the clock signal CK. The terminal Q of the DFF 152 is connected to an input terminal D of the DFF 153, and an output from a terminal /Q of the DFF 153 changes after a delay of 1 clock from the output from the terminal Q of the DFF 152. In this case, since switching between the signal of 1 MHz and the signal of 100 kHz is performed at random, the delay of 1 clock corresponds to 1 $\mu$s or 10 $\mu$s.

Figure 2:
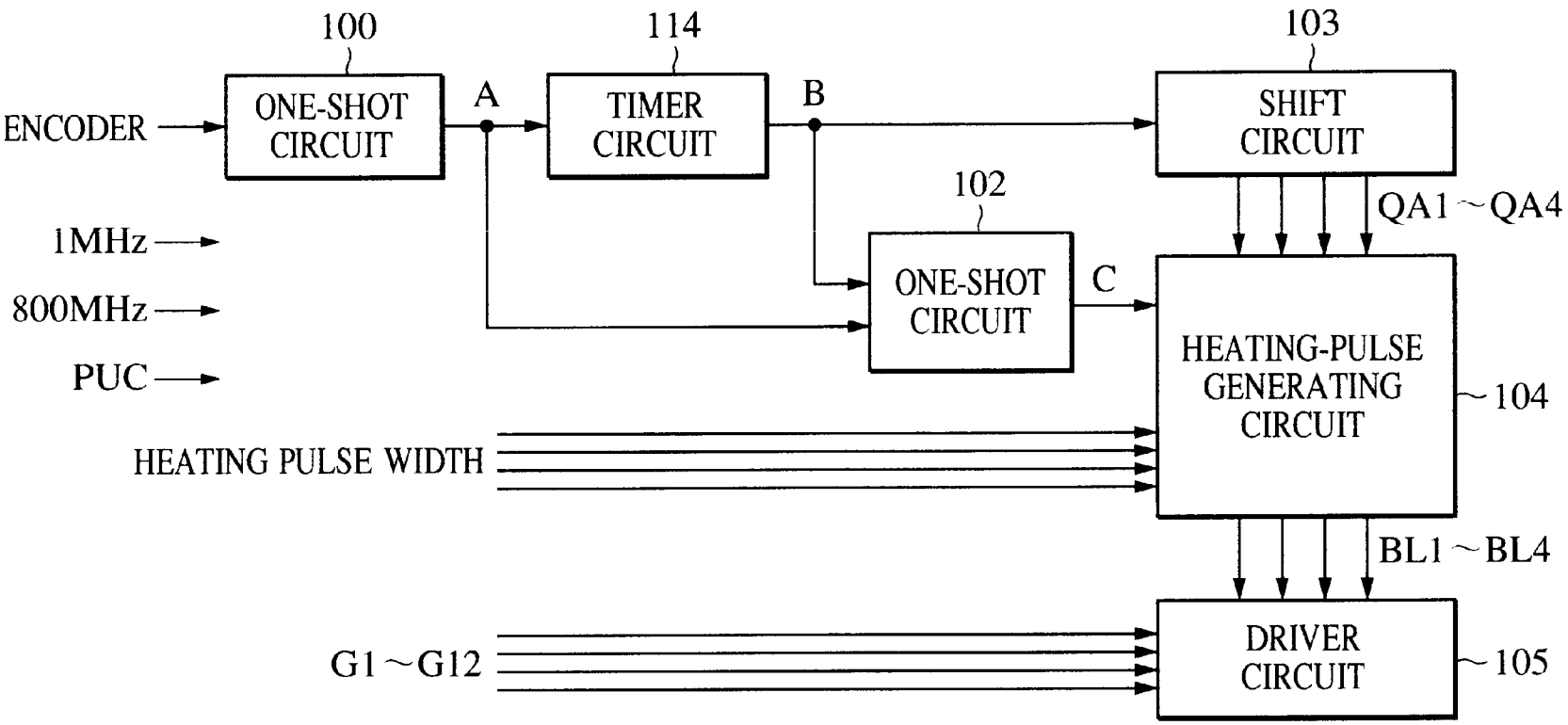
FIG. 2 is a block diagram of a driving circuit for time-division driving of a plurality of nozzles in the related art.
Figure 3:
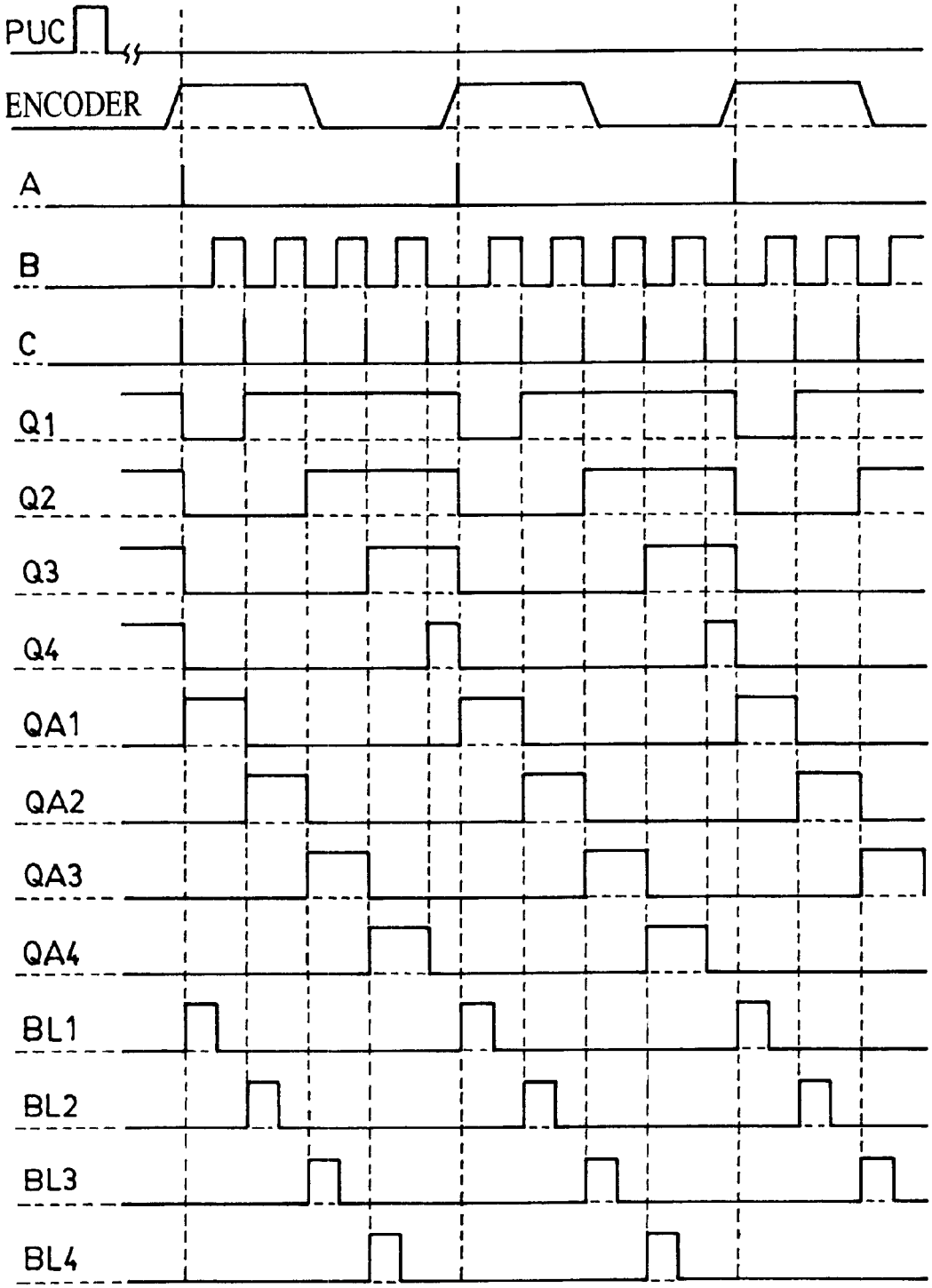
FIG. 3 is an operation timing chart of the components of the driving circuit shown in FIG. 2.

The AND gate 154 outputs an AND signal A between the output from the terminal Q of the DFF 152 and the output from the terminal /Q of the DFF 153. That is, the one-shot circuit 100 of this embodiment outputs a signal A which becomes high for only 1 $\mu$s or 10 $\mu$s at the rising edge of the encoder signal. The block-driving reference signal generating circuit 101 may have a configuration similar to the timer circuit 114 shown in FIG. 2.

Figure 25:
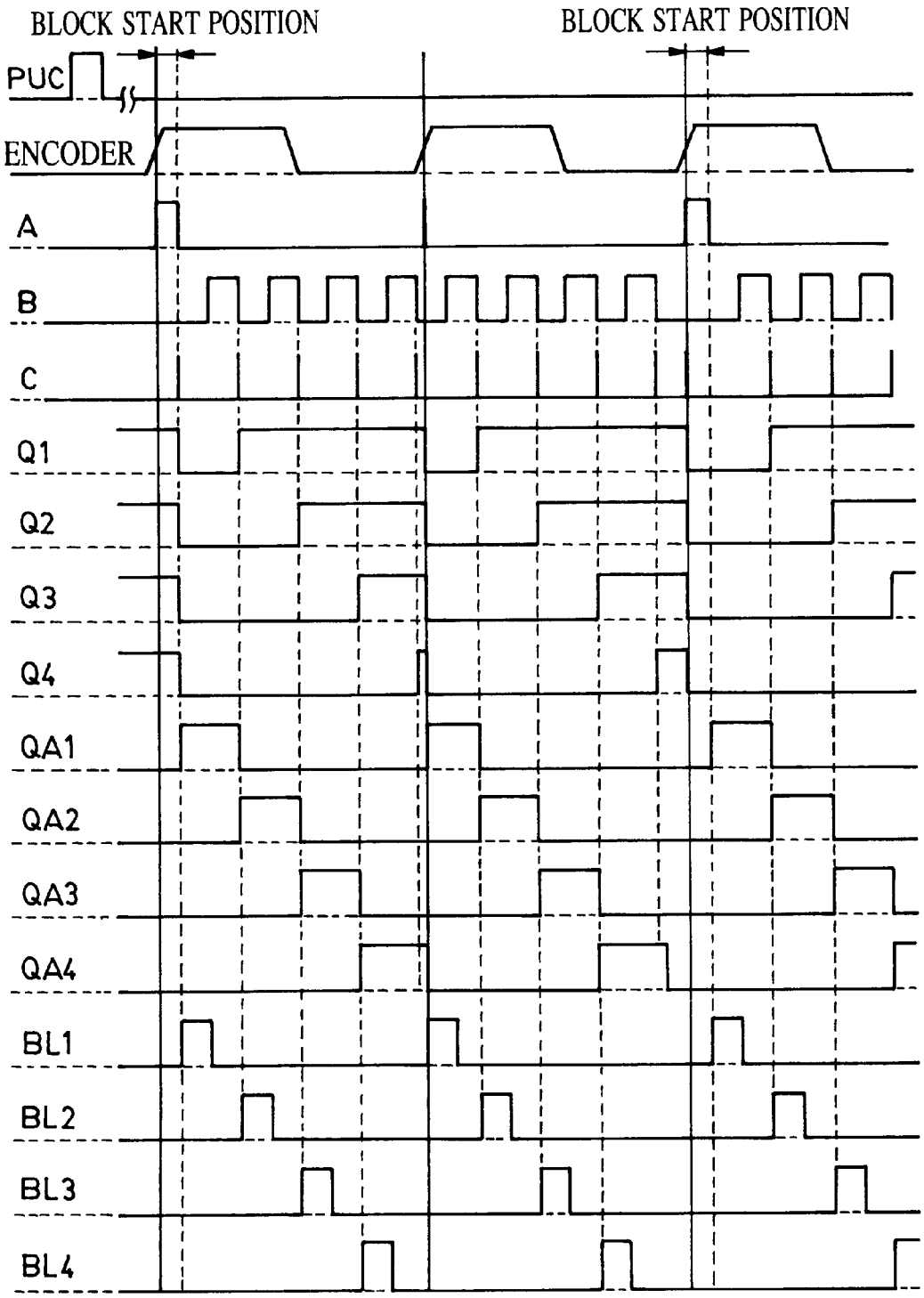
FIG. 25 is a timing chart of the components in the second embodiment.

As described above, the driving period for the discharge heaters start after a delay of 1 $\mu$s or 10 $\mu$s from the rising edge of the encoder signal, as shown in FIG. 25. Consequently, the discharge frequency slightly shifts, and the meniscus surface can be prevented from resonating. That is, since the block driving start timings in the discharge periods change at random so that they are not equal, the frequency components of the pressure wave in the ink chamber are dispersed, and the meniscus surface is prevented from resonating, so that meniscus vibration is substantially avoided.

The above-described delay may be determined appropriately.

While the block periods and the block driving start timings in the discharge periods change at random in the above embodiments, it is satisfactory as long as driving is performed for different block periods or at different start timings. However, it is preferable to change the discharge period and the block driving start timing at random since this can eliminate synchronism.

In the above description, the present invention has been applied to an ink-jet head in which an electrothermal conversion element (discharge heater) is disposed inside each discharge opening, and ink is discharged by using the expansion power of a bubble generated by heat which is produced by energizing the discharge heater (for example, a bubble-jet type, advocated by the present applicant, which discharges ink by producing film boiling in ink). The present invention is also effectively applicable to ink-jet heads and ink-jet printing apparatuses using other ink-jet printing methods (for example, a type using a piezoelectric element as a recording element for generating energy to be used to discharge ink) as long as the amount of ink to be discharged and the discharging direction may be changed due to meniscus vibration.

As described above, in the above embodiments, resonance of the meniscus surface in response to the pressure wave in the ink chamber is suppressed to avoid meniscus vibration, by driving the ink-jet head so that the frequencies due to the changes in pressure in the ink chamber resulting from the ink discharging operation are different from the nozzle resonance frequencies in the ink-jet head. More specifically, when the ink-jet head is driven so that a plurality of discharge openings are caused to discharge ink in a time-division manner within the driving period of the ink-jet head, the driving periods of the discharging openings to be driven in a time-division manner are not equal. Alternatively, the period between the beginning of the driving period of the ink-jet head and the beginning of the ink discharging operation varies according to the driving periods (for example, the period from the beginning of the discharge period to the first ink discharging operation).

According to the above, the resonance of the meniscus surface can be prevented, and the meniscus vibration can be thereby reduced. As a result, it is possible to achieve high-quality printing in which ink is discharged in a stable state and mottles and bands are not formed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording apparatus for performing recording by using an ink-jet head having a plurality of recording elements for discharging ink from a plurality of discharge openings, and an ink chamber for supplying the ink to said discharge openings, said ink-jet recording apparatus comprising:

driving means for driving said recording elements; and block dividing means for dividing said plurality of recording elements into a plurality of blocks, and for providing a plurality of driving signals to said driving means for driving said recording elements block by block such that driving periods of said blocks are not equal.

2. An ink-jet recording apparatus for performing recording by using an ink-jet head having a plurality of recording elements for discharging ink from a plurality of discharge openings, and an ink chamber for supplying the ink to said discharge openings, said ink-jet recording apparatus comprising:

driving means for driving said recording elements; and block dividing means for dividing said plurality of recording elements into a plurality of blocks, and for providing a plurality of driving signals to said driving means for driving said recording elements block by block with equal driving periods such that a time at which the driving signal of a first block starts varies according to the driving periods.

3. An ink-jet recording apparatus according to claim 1 or 2, wherein said recording elements are heat-generating elements which apply heat energy for producing film boiling in the ink.

4. An ink-jet recording apparatus according to claim 1 or 2, wherein said recording elements are piezoelectric elements.

5. An ink-jet recording apparatus according to claim 1 or 2, wherein said recording elements are respectively placed in channels through which the ink is supplied from said ink chamber to said discharge openings.

6. An ink-jet recording apparatus according to claim 1 or 2, further comprising:

means for moving said ink-jet head and a printing medium relative to each other for scanning.

7. A driving method for an ink-jet head having a plurality of recording elements for discharging ink from a plurality of discharge openings, and an ink chamber for supplying the ink to said discharge openings, said driving method comprising:

a driving step for driving said recording elements; and a block dividing step of dividing said plurality of recording elements into a plurality of blocks, and of providing a plurality of driving signals for said driving step for driving said recording elements block by block such that driving periods of said blocks are not equal.

8. A driving method for an ink-jet head having a plurality of recording elements for discharging ink from a plurality of discharge openings, and an ink chamber for supplying the ink to said discharge openings, said driving method comprising:

a driving step for driving said recording elements; and a block dividing step of dividing said plurality of recording elements into a plurality of blocks, and of providing a plurality of driving signals for said driving step for driving said recording elements block by block with equal driving periods such that a time at which the driving signal of a first block starts varies according to the driving periods.

9. A driving method according to claim 7 or 8, wherein said recording elements are driven to generate heat energy which produces film boiling in the ink.

10. A driving method according to claim 7 or 8, wherein said recording elements are driven to mechanically cause the ink to be discharged.

* * * * *